US008752598B2

(12) United States Patent
Denenburg et al.

(10) Patent No.: US 8,752,598 B2
(45) Date of Patent: Jun. 17, 2014

(54) LIQUID DRUG TRANSFER ASSEMBLY

(75) Inventors: Igor Denenburg, Gedera (IL); Nimrod Lev, Savion (IL); Mordechai Bukhman, Netanya (IL)

(73) Assignee: MEDIMOP Medical Projects Ltd., Ra'anana (IL)

( * ) Notice: Subject to any disclaimer, the term of this patent is extended or adjusted under 35 U.S.C. 154(b) by 0 days.

(21) Appl. No.: 14/005,751

(22) PCT Filed: Apr. 17, 2012

(86) PCT No.: PCT/IL2012/000164

§ 371 (c)(1), (2), (4) Date: Sep. 17, 2013

(87) PCT Pub. No.: WO2012/143921

PCT Pub. Date: Oct. 26, 2012

(65) Prior Publication Data

US 2014/0020793 A1 Jan. 23, 2014

(30) Foreign Application Priority Data

Apr. 17, 2011 (IL) ..... 212420

(51) Int. Cl.
*B67C 3/00* (2006.01)

(52) U.S. Cl.
USPC ..... 141/329; 141/27; 141/105; 141/319; 604/414

(58) Field of Classification Search
CPC ..... A61J 2001/201
USPC ..... 141/27, 100, 105, 319, 329, 330; 604/411, 412, 413, 414
See application file for complete search history.

(56) References Cited

U.S. PATENT DOCUMENTS

| | | | |
|---|---|---|---|
| 62,333 | A | 2/1867 | Holl |
| 1,021,681 | A | 3/1912 | Jennings, John F. |
| 1,704,817 | A | 3/1929 | Ayers |

(Continued)

FOREIGN PATENT DOCUMENTS

| | | | |
|---|---|---|---|
| DE | 1913926 | A1 | 9/1970 |
| DE | 4122476 | A1 | 1/1993 |

(Continued)

OTHER PUBLICATIONS

Office Action issued Nov. 11, 2013 in IL Application No. 218730.

(Continued)

*Primary Examiner* — Jason K Niesz
(74) *Attorney, Agent, or Firm* — Panitch Schwarze Belisario & Nadel LLP

(57) ABSTRACT

Liquid drug transfer assemblies for use with a drug vial having a drug vial opening stopped by a drug vial stopper. The liquid drug transfer assemblies include a drug vial stopper puncturing member for puncturing a drug vial stopper. The liquid drug transfer assemblies also include a drug vial adapter having a drug vial adapter skirt, an upright drug vial adapter port and a drug vial adapter sleeve downward depending opposite the upright drug vial adapter port and in flow communication therewith. The drug vial adapter is slidingly disposed on the drug vial stopper puncturing member such that on mounting the liquid drug transfer assembly on the drug vial, the drug vial stopper puncturing member punctures the drug vial stopper to form a throughgoing puncture bore and the drug vial adapter sleeve lines the puncture bore.

12 Claims, 20 Drawing Sheets

(56) References Cited

U.S. PATENT DOCUMENTS 1,930,944 A 10/1933 Schmitz, Jr.
2,326,490 A 8/1943 Perelson
2,931,668 A 4/1960 Baley
2,968,497 A 1/1961 Treleman
3,059,643 A 10/1962 Barton
D198,499 S 6/1964 Harautuneian
3,484,849 A 12/1969 Huebner et al.
3,618,637 A 11/1971 Santomieri
3,757,981 A 9/1973 Harris, Sr. et al.
3,788,524 A 1/1974 Davis et al.
3,822,700 A 7/1974 Pennington
3,826,261 A 7/1974 Killinger
3,872,992 A * 3/1975 Larson ..... 215/249
3,885,607 A 5/1975 Peltier
3,938,520 A 2/1976 Scislowicz et al.
3,957,052 A 5/1976 Topham
3,977,555 A 8/1976 Larson
3,993,063 A 11/1976 Larrabee
4,020,839 A 5/1977 Klapp
4,051,852 A 10/1977 Villari
4,109,670 A 8/1978 Slagel
4,121,585 A 10/1978 Becker, Jr.
4,161,178 A 7/1979 Genese
4,187,848 A 2/1980 Taylor
4,203,067 A 5/1980 Fitzky et al.
4,203,443 A 5/1980 Genese
4,210,173 A 7/1980 Choksi et al.
D257,286 S 10/1980 Folkman
4,253,501 A 3/1981 Ogle
4,296,786 A 10/1981 Brignola
4,303,067 A 12/1981 Connolly et al.
4,312,349 A 1/1982 Cohen
4,314,586 A 2/1982 Folkman
4,328,802 A 5/1982 Curley et al.
4,335,717 A 6/1982 Bujan et al.
D267,199 S 12/1982 Koenig
4,376,634 A 3/1983 Prior et al.
D268,871 S 5/1983 Benham et al.
4,392,850 A 7/1983 Elias et al.
4,410,321 A 10/1983 Pearson et al.
4,411,662 A 10/1983 Pearson
D271,421 S 11/1983 Fetterman
4,434,823 A 3/1984 Hudspith
4,465,471 A 8/1984 Harris et al.
4,475,915 A 10/1984 Sloane
4,493,348 A 1/1985 Lemmons
4,505,709 A 3/1985 Froning et al.
4,507,113 A 3/1985 Dunlap
D280,018 S 8/1985 Scott
4,532,969 A 8/1985 Kwaan
4,564,054 A 1/1986 Gustavsson
4,573,993 A 3/1986 Hoag et al.
4,576,211 A 3/1986 Valentini et al.
4,581,014 A 4/1986 Millerd et al.
4,588,396 A 5/1986 Stroebel et al.
4,588,403 A 5/1986 Weiss et al.
D284,603 S 7/1986 Loignon
4,604,093 A 8/1986 Brown et al.
4,607,671 A 8/1986 Aalto et al.
4,614,437 A 9/1986 Buehler
4,638,975 A 1/1987 Iuchi et al.
4,639,019 A 1/1987 Mittleman
4,667,927 A 5/1987 Oscarsson
4,676,530 A 6/1987 Nordgren et al.
4,683,975 A 8/1987 Booth et al.
4,697,622 A 10/1987 Swift et al.
4,721,133 A 1/1988 Sundblom
4,729,401 A 3/1988 Raines
4,735,608 A 4/1988 Sardam
4,743,229 A 5/1988 Chu
4,743,243 A 5/1988 Vaillancourt
4,752,292 A 6/1988 Lopez et al.
4,758,235 A 7/1988 Tu
4,759,756 A 7/1988 Forman et al.
4,778,447 A 10/1988 Velde et al.
4,787,898 A 11/1988 Raines
4,797,898 A 1/1989 Martinez
4,804,366 A 2/1989 Zdeb et al.
4,832,690 A 5/1989 Kuu
4,834,152 A 5/1989 Howson et al.
4,857,062 A 8/1989 Russell
4,865,592 A 9/1989 Rycroft
4,909,290 A 3/1990 Coccia
4,931,040 A 6/1990 Haber et al.
4,932,944 A 6/1990 Jagger et al.
4,967,797 A 11/1990 Manska
D314,050 S 1/1991 Sone
D314,622 S 2/1991 Andersson et al.
4,997,430 A 3/1991 Van der Heiden et al.
5,006,114 A 4/1991 Rogers et al.
5,035,686 A 7/1991 Crittenden et al.
5,041,105 A 8/1991 D'Alo et al.
5,045,066 A 9/1991 Scheuble et al.
5,049,129 A 9/1991 Zdeb et al.
5,053,015 A 10/1991 Gross
5,061,248 A 10/1991 Sacco
5,088,996 A 2/1992 Kopfer et al.
5,096,575 A 3/1992 Cosack
5,104,387 A 4/1992 Pokorney et al.
5,113,904 A 5/1992 Aslanian
5,122,124 A 6/1992 Novacek et al.
5,125,908 A 6/1992 Cohen
5,125,915 A 6/1992 Berry et al.
D328,788 S 8/1992 Sagae et al.
5,171,230 A 12/1992 Eland et al.
5,201,705 A 4/1993 Berglund et al.
5,201,717 A 4/1993 Wyatt et al.
5,203,771 A 4/1993 Melker et al.
5,203,775 A 4/1993 Frank et al.
5,211,638 A 5/1993 Dudar et al.
5,232,029 A 8/1993 Knox et al.
5,232,109 A 8/1993 Tirrell et al.
5,242,432 A 9/1993 DeFrank
5,247,972 A 9/1993 Tetreault
D341,420 S 11/1993 Conn
5,269,768 A 12/1993 Cheung
5,270,219 A 12/1993 DeCastro et al.
5,279,576 A 1/1994 Loo et al.
5,288,290 A 2/1994 Brody
5,300,034 A 4/1994 Behnke et al.
5,301,685 A 4/1994 Guirguis
5,304,163 A 4/1994 Bonnici et al.
5,308,483 A 5/1994 Sklar et al.
5,312,377 A 5/1994 Dalton
5,328,474 A 7/1994 Raines
D349,648 S 8/1994 Tirrell et al.
5,334,163 A 8/1994 Sinnett
5,334,179 A 8/1994 Poli et al.
5,342,346 A 8/1994 Honda et al.
5,344,417 A 9/1994 Wadsworth, Jr.
5,350,372 A 9/1994 Ikeda et al.
5,364,386 A 11/1994 Fukuoka et al.
5,364,387 A 11/1994 Sweeney
5,374,264 A 12/1994 Wadsworth, Jr.
5,385,547 A 1/1995 Wong et al.
5,397,303 A 3/1995 Sancoff et al.
5,429,614 A 7/1995 Fowles et al.
5,433,330 A 7/1995 Yatsko et al.
5,445,630 A 8/1995 Richmond
5,445,631 A 8/1995 Uchida
5,451,374 A 9/1995 Molina
5,454,805 A 10/1995 Brony
5,464,111 A 11/1995 Vacek et al.
5,464,123 A 11/1995 Scarrow
5,466,219 A 11/1995 Lynn et al.
5,466,220 A 11/1995 Brenneman
5,470,327 A 11/1995 Helgren et al.
5,471,994 A 12/1995 Guirguis
5,478,337 A 12/1995 Okamoto et al.
5,492,147 A 2/1996 Challender et al.
D369,406 S 4/1996 Niedospial et al.
5,505,714 A 4/1996 Dassa et al.
5,509,433 A 4/1996 Paradis
5,520,659 A 5/1996 Hedges

(56) References Cited

U.S. PATENT DOCUMENTS 5,526,853 A 6/1996 McPhee et al.
5,527,306 A 6/1996 Haining
5,531,695 A 7/1996 Swisher
5,547,471 A 8/1996 Thompson et al.
5,549,577 A 8/1996 Siegel et al.
5,554,128 A 9/1996 Hedges
5,566,729 A 10/1996 Grabenkort et al.
5,569,191 A 10/1996 Meyer
5,573,281 A 11/1996 Keller
5,578,015 A 11/1996 Robb
5,583,052 A 12/1996 Portnoff et al.
5,584,819 A 12/1996 Kopfer
5,591,143 A 1/1997 Trombley, III et al.
5,603,706 A 2/1997 Wyatt et al.
5,607,439 A 3/1997 Yoon
5,611,576 A 3/1997 Guala
5,616,203 A 4/1997 Stevens
5,636,660 A 6/1997 Pfleiderer et al.
5,641,010 A 6/1997 Maier
5,645,538 A 7/1997 Richmond
5,647,845 A 7/1997 Haber et al.
5,651,776 A 7/1997 Appling et al.
5,653,686 A 8/1997 Coulter et al.
5,674,195 A 10/1997 Truthan
5,676,346 A 10/1997 Leinsing
5,685,845 A 11/1997 Grimard
5,699,821 A 12/1997 Paradis
5,702,019 A 12/1997 Grimard
5,718,346 A 2/1998 Weiler
D393,722 S 4/1998 Fangrow, Jr. et al.
5,738,144 A 4/1998 Rogers
5,743,312 A 4/1998 Pfeifer et al.
5,746,733 A 5/1998 Capaccio et al.
5,755,696 A 5/1998 Caizza
5,766,211 A 6/1998 Wood et al.
5,772,630 A 6/1998 Ljungquist
5,772,652 A 6/1998 Zielinski
RE35,841 E 7/1998 Frank et al.
5,776,116 A 7/1998 Lopez et al.
5,782,872 A 7/1998 Muller
5,806,831 A 9/1998 Paradis
5,817,082 A 10/1998 Niedospial, Jr. et al.
5,820,621 A * 10/1998 Yale et al. ..... 604/411
5,827,262 A 10/1998 Neftel et al.
5,832,971 A 11/1998 Yale et al.
5,833,213 A 11/1998 Ryan
5,834,744 A 11/1998 Risman
5,839,715 A 11/1998 Leinsing
5,853,406 A 12/1998 Masuda et al.
5,871,110 A 2/1999 Grimard et al.
5,873,872 A 2/1999 Thibault et al.
5,879,337 A 3/1999 Kuracina et al.
5,879,345 A 3/1999 Aneas
5,887,633 A 3/1999 Yale et al.
5,890,610 A 4/1999 Jansen et al.
5,891,129 A 4/1999 Daubert et al.
5,893,397 A 4/1999 Peterson et al.
5,897,526 A 4/1999 Vaillancourt
5,899,468 A 5/1999 Apps et al.
5,902,280 A 5/1999 Powles et al.
5,902,298 A 5/1999 Niedospial, Jr. et al.
5,911,710 A 6/1999 Barry et al.
5,919,182 A 7/1999 Avallone
5,921,419 A 7/1999 Niedospial, Jr. et al.
5,924,584 A 7/1999 Hellstrom et al.
5,925,029 A 7/1999 Jansen et al.
5,935,112 A 8/1999 Stevens et al.
5,941,848 A 8/1999 Nishimoto et al.
5,944,700 A 8/1999 Nguyen et al.
5,954,104 A 9/1999 Daubert et al.
5,971,181 A 10/1999 Niedospial, Jr. et al.
5,971,965 A 10/1999 Mayer
5,989,237 A 11/1999 Fowles et al.
6,003,566 A 12/1999 Thibault et al.
6,004,278 A 12/1999 Botich et al.
6,019,750 A 2/2000 Fowles et al.
6,022,339 A 2/2000 Fowles et al.
6,036,171 A 3/2000 Weinheimer et al.
6,039,093 A 3/2000 Mrotzek et al.
6,039,302 A 3/2000 Cote, Sr. et al.
D422,357 S 4/2000 Niedospial, Jr. et al.
6,063,068 A 5/2000 Fowles et al.
D427,308 S 6/2000 Zinger
6,070,623 A 6/2000 Aneas
6,071,270 A 6/2000 Fowles et al.
6,080,132 A 6/2000 Cole et al.
6,086,762 A 7/2000 Guala
6,089,541 A 7/2000 Weinheimer et al.
6,090,091 A 7/2000 Fowles et al.
6,090,093 A 7/2000 Thibault et al.
6,099,511 A 8/2000 Devos et al.
6,113,068 A 9/2000 Ryan
6,113,583 A 9/2000 Fowles et al.
6,117,114 A 9/2000 Paradis
6,139,534 A 10/2000 Niedospial, Jr. et al.
6,142,446 A 11/2000 Leinsing
6,146,362 A 11/2000 Turnbull et al.
6,156,025 A 12/2000 Niedospial, Jr. et al.
6,159,192 A 12/2000 Fowles et al.
6,168,037 B1 1/2001 Grimard
6,171,287 B1 1/2001 Lynn et al.
6,171,293 B1 1/2001 Rowley et al.
6,173,852 B1 1/2001 Browne
6,174,304 B1 1/2001 Weston
6,179,822 B1 1/2001 Niedospial, Jr.
6,179,823 B1 1/2001 Niedospial, Jr.
6,206,861 B1 3/2001 Mayer
6,221,041 B1 4/2001 Russo
6,221,054 B1 4/2001 Martin et al.
6,221,065 B1 4/2001 Davis
6,238,372 B1 5/2001 Zinger et al.
6,245,044 B1 6/2001 Daw et al.
D445,501 S 7/2001 Niedospial, Jr.
D445,895 S 7/2001 Svendsen
6,253,804 B1 7/2001 Safabash
6,258,078 B1 7/2001 Thilly
6,280,430 B1 8/2001 Neftel et al.
6,290,688 B1 9/2001 Lopez et al.
6,296,621 B1 10/2001 Masuda et al.
6,299,131 B1 10/2001 Ryan
6,343,629 B1 2/2002 Wessman et al.
6,348,044 B1 2/2002 Coletti et al.
6,358,236 B1 3/2002 DeFoggi et al.
6,364,866 B1 4/2002 Furr et al.
6,378,576 B2 4/2002 Thibault et al.
6,378,714 B1 4/2002 Jansen et al.
6,379,340 B1 4/2002 Zinger et al.
6,382,442 B1 5/2002 Thibault et al.
6,408,897 B1 6/2002 Laurent et al.
6,409,708 B1 6/2002 Wessman
6,440,107 B1 8/2002 Trombley, III et al.
6,453,949 B1 9/2002 Chau
6,453,956 B2 9/2002 Safabash
6,474,375 B2 11/2002 Spero et al.
6,478,788 B1 11/2002 Aneas
D468,015 S 12/2002 Horppu
6,499,617 B1 12/2002 Niedospial, Jr. et al.
6,503,240 B1 1/2003 Niedospial, Jr. et al.
6,503,244 B2 1/2003 Hayman
6,520,932 B2 2/2003 Taylor
6,524,278 B1 2/2003 Campbell et al.
6,524,295 B2 2/2003 Daubert et al.
D472,316 S 3/2003 Douglas et al.
6,530,903 B2 3/2003 Wang et al.
6,537,263 B1 3/2003 Aneas
D472,630 S 4/2003 Douglas et al.
6,544,246 B1 4/2003 Niedospial, Jr.
6,551,299 B2 4/2003 Miyoshi et al.
6,558,365 B2 5/2003 Zinger et al.
6,571,837 B2 6/2003 Jansen et al.
6,572,591 B2 6/2003 Mayer
6,575,955 B2 6/2003 Azzolini
6,581,593 B1 6/2003 Rubin et al.
6,582,415 B1 6/2003 Fowles et al.

(56) References Cited

U.S. PATENT DOCUMENTS 6,591,876 B2 7/2003 Safabash
6,601,721 B2 8/2003 Jansen et al.
6,626,309 B1 9/2003 Jansen et al.
D482,121 S 11/2003 Harding et al.
D482,447 S 11/2003 Harding et al.
6,651,956 B2 11/2003 Miller
6,652,509 B1 11/2003 Helgren et al.
D483,487 S 12/2003 Harding et al.
D483,869 S 12/2003 Tran et al.
6,656,433 B2 12/2003 Sasso
6,666,852 B2 12/2003 Niedospial, Jr.
6,681,810 B2 1/2004 Weston
6,681,946 B1 1/2004 Jansen et al.
6,682,509 B2 1/2004 Lopez
6,692,478 B1 2/2004 Paradis
6,692,829 B2 2/2004 Stubler et al.
6,695,829 B2 2/2004 Hellstrom et al.
6,699,229 B2 3/2004 Zinger et al.
6,706,022 B1 3/2004 Leinsing et al.
6,706,031 B2 3/2004 Manera
6,715,520 B2 4/2004 Andreasson et al.
6,729,370 B2 5/2004 Norton et al.
6,736,798 B2 5/2004 Ohkubo et al.
6,745,998 B2 6/2004 Doyle
6,746,438 B1 6/2004 Arnissolle
6,752,180 B2 6/2004 Delay
D495,416 S 8/2004 Dimeo et al.
D496,457 S 9/2004 Prais et al.
6,802,490 B2 10/2004 Leinsing et al.
6,832,994 B2 12/2004 Niedospial, Jr. et al.
6,852,103 B2 2/2005 Fowles et al.
6,875,203 B1 4/2005 Fowles et al.
6,875,205 B2 4/2005 Leinsing
6,878,131 B2 4/2005 Novacek et al.
6,890,328 B2 5/2005 Fowles et al.
6,901,975 B2 6/2005 Aramata et al.
6,945,417 B2 9/2005 Jansen et al.
6,948,522 B2 9/2005 Newbrough et al.
6,949,086 B2 9/2005 Ferguson et al.
6,957,745 B2 10/2005 Thibault et al.
RE38,996 E 2/2006 Crawford et al.
6,994,315 B2 2/2006 Ryan et al.
6,997,916 B2 2/2006 Simas, Jr. et al.
6,997,917 B2 2/2006 Niedospial, Jr. et al.
7,024,968 B2 4/2006 Raudabough et al.
7,070,589 B2 7/2006 Lolachi et al.
7,074,216 B2 7/2006 Fowles et al.
7,083,600 B2 8/2006 Meloul
7,086,431 B2 8/2006 D'Antonio et al.
7,100,890 B2 9/2006 Cote, Sr. et al.
7,150,735 B2 12/2006 Hickle
7,192,423 B2 3/2007 Wong
7,195,623 B2 3/2007 Burroughs et al.
7,241,285 B1 7/2007 Dikeman
7,294,122 B2 11/2007 Kubo et al.
7,306,199 B2 12/2007 Leinsing et al.
D561,348 S 2/2008 Zinger et al.
7,326,188 B1 2/2008 Russell et al.
7,326,194 B2 2/2008 Zinger et al.
7,350,764 B2 4/2008 Raybuck
7,354,422 B2 4/2008 Riesenberger et al.
7,354,427 B2 4/2008 Fangrow
7,425,209 B2 9/2008 Fowles et al.
7,435,246 B2 10/2008 Zihlmann
7,452,348 B2 11/2008 Hasegawa
7,470,257 B2 12/2008 Norton et al.
7,470,265 B2 12/2008 Brugger et al.
7,472,932 B2 1/2009 Weber et al.
7,488,297 B2 2/2009 Flaherty
7,491,197 B2 2/2009 Jansen et al.
7,497,848 B2 3/2009 Leinsing et al.
7,523,967 B2 4/2009 Steppe
7,530,546 B2 5/2009 Ryan et al.
D595,420 S 6/2009 Suzuki et al.
D595,421 S 6/2009 Suzuki et al.
7,540,863 B2 6/2009 Haindl
7,540,865 B2 6/2009 Griffin et al.
7,544,191 B2 6/2009 Peluso et al.
D595,862 S 7/2009 Suzuki et al.
D595,863 S 7/2009 Suzuki et al.
7,611,487 B2 11/2009 Woehr et al.
7,611,502 B2 11/2009 Daly
7,615,041 B2 11/2009 Sullivan et al.
7,628,779 B2 12/2009 Aneas
7,632,261 B2 12/2009 Zinger et al.
D608,900 S 1/2010 Giraud et al.
7,654,995 B2 2/2010 Warren et al.
7,695,445 B2 4/2010 Yuki
D616,090 S 5/2010 Kawamura
7,713,247 B2 5/2010 Lopez
7,717,886 B2 5/2010 Lopez
7,722,090 B2 5/2010 Burton et al.
D616,984 S 6/2010 Gilboa
7,731,678 B2 6/2010 Tennican et al.
7,743,799 B2 6/2010 Mosler et al.
7,758,082 B2 7/2010 Weigel et al.
7,762,524 B2 7/2010 Cawthon et al.
7,766,304 B2 8/2010 Phillips
7,771,383 B2 8/2010 Truitt et al.
7,799,009 B2 9/2010 Niedospial, Jr. et al.
7,803,140 B2 9/2010 Fangrow, Jr.
D627,216 S 11/2010 Fulginiti
D630,732 S 1/2011 Lev et al.
7,862,537 B2 1/2011 Zinger et al.
7,867,215 B2 1/2011 Akerlund et al.
7,879,018 B2 2/2011 Zinger et al.
D634,007 S 3/2011 Zinger et al.
7,900,659 B2 3/2011 Whitley et al.
D637,713 S 5/2011 Nord et al.
D644,104 S 8/2011 Maeda et al.
7,993,328 B2 8/2011 Whitley
8,016,809 B2 9/2011 Zinger et al.
8,025,653 B2 9/2011 Capitaine et al.
8,029,472 B2 10/2011 Leinsing et al.
8,038,123 B2 10/2011 Ruschke et al.
8,066,688 B2 11/2011 Zinger et al.
8,070,739 B2 12/2011 Zinger et al.
8,096,525 B2 1/2012 Ryan
8,105,314 B2 1/2012 Fangrow, Jr.
D655,017 S 2/2012 Mosler et al.
8,122,923 B2 2/2012 Kraus et al.
D655,071 S 3/2012 Davila
8,157,784 B2 4/2012 Rogers
8,167,863 B2 5/2012 Yow
8,172,824 B2 5/2012 Pfeifer et al.
8,177,768 B2 5/2012 Leinsing
8,182,452 B2 5/2012 Mansour et al.
8,197,459 B2 6/2012 Jansen et al.
8,211,069 B2 7/2012 Fangrow, Jr.
8,225,959 B2 7/2012 Lambrecht
8,241,268 B2 8/2012 Whitley
8,262,628 B2 9/2012 Fangrow, Jr.
D669,980 S 10/2012 Lev et al.
8,287,513 B2 10/2012 Ellstrom et al.
D674,088 S 1/2013 Lev et al.
8,454,573 B2 6/2013 Wyatt et al.
8,480,646 B2 7/2013 Nord et al.
8,506,548 B2 8/2013 Okiyama
8,523,837 B2 9/2013 Wiggins et al.
8,545,476 B2 * 10/2013 Ariagno et al. ..... 604/414
8,551,067 B2 10/2013 Zinger et al.
8,556,879 B2 10/2013 Okiyama
2001/0000347 A1 4/2001 Hellstrom et al.
2001/0025671 A1 10/2001 Safabash
2001/0029360 A1 10/2001 Miyoshi et al.
2001/0051793 A1 12/2001 Weston
2002/0017328 A1 2/2002 Loo
2002/0066715 A1 6/2002 Niedospial
2002/0087118 A1 7/2002 Reynolds et al.
2002/0087141 A1 7/2002 Zinger et al.
2002/0087144 A1 7/2002 Zinger et al.
2002/0121496 A1 9/2002 Thiebault et al.
2002/0123736 A1 9/2002 Fowles et al.
2002/0127150 A1 9/2002 Sasso

(56) References Cited

U.S. PATENT DOCUMENTS

| | | | |
|---|---|---|---|
| 2002/0128628 | A1 | 9/2002 | Fathallah |
| 2002/0173752 | A1 | 11/2002 | Polzin |
| 2002/0193777 | A1 | 12/2002 | Aneas |
| 2003/0028156 | A1 | 2/2003 | Juliar |
| 2003/0036725 | A1 | 2/2003 | Lavi et al. |
| 2003/0068354 | A1 | 4/2003 | Reif et al. |
| 2003/0073971 | A1 | 4/2003 | Saker |
| 2003/0100866 | A1 | 5/2003 | Reynolds |
| 2003/0120209 | A1 | 6/2003 | Jensen et al. |
| 2003/0153895 | A1 | 8/2003 | Leinsing |
| 2003/0187420 | A1 | 10/2003 | Akerlund et al. |
| 2003/0191445 | A1 | 10/2003 | Wallen et al. |
| 2003/0195479 | A1 | 10/2003 | Kuracina et al. |
| 2003/0199846 | A1 | 10/2003 | Fowles et al. |
| 2003/0199847 | A1 | 10/2003 | Akerlund et al. |
| 2004/0024354 | A1 | 2/2004 | Reynolds |
| 2004/0044327 | A1 | 3/2004 | Hasegawa |
| 2004/0073189 | A1 | 4/2004 | Wyatt et al. |
| 2004/0153047 | A1 | 8/2004 | Blank et al. |
| 2004/0181192 | A1 | 9/2004 | Cuppy |
| 2004/0204699 | A1 | 10/2004 | Hanly et al. |
| 2004/0217315 | A1 | 11/2004 | Doyle |
| 2004/0236305 | A1 | 11/2004 | Jansen et al. |
| 2005/0015070 | A1 | 1/2005 | Delnevo et al. |
| 2005/0055008 | A1 | 3/2005 | Paradis et al. |
| 2005/0124964 | A1 | 6/2005 | Niedospial et al. |
| 2005/0137566 | A1 | 6/2005 | Fowles et al. |
| 2005/0148994 | A1 | 7/2005 | Leinsing |
| 2005/0159724 | A1 | 7/2005 | Enerson |
| 2005/0182383 | A1 | 8/2005 | Wallen |
| 2005/0261637 | A1 | 11/2005 | Miller |
| 2006/0030832 | A1 | 2/2006 | Niedospial et al. |
| 2006/0079834 | A1 | 4/2006 | Tennican et al. |
| 2006/0089594 | A1 | 4/2006 | Landau |
| 2006/0089603 | A1 | 4/2006 | Truitt et al. |
| 2006/0095015 | A1 | 5/2006 | Hobbs et al. |
| 2006/0106360 | A1 | 5/2006 | Wong |
| 2006/0135948 | A1 | 6/2006 | Varma |
| 2006/0253084 | A1 | 11/2006 | Nordgren |
| 2007/0024995 | A1 | 2/2007 | Hayashi |
| 2007/0060904 | A1 | 3/2007 | Vedrine et al. |
| 2007/0079894 | A1 | 4/2007 | Kraus et al. |
| 2007/0083164 | A1 | 4/2007 | Barrelle et al. |
| 2007/0088252 | A1 | 4/2007 | Pestotnik et al. |
| 2007/0088293 | A1 | 4/2007 | Fangrow |
| 2007/0088313 | A1 | 4/2007 | Zinger et al. |
| 2007/0106244 | A1 | 5/2007 | Mosler et al. |
| 2007/0112324 | A1 | 5/2007 | Hamedi-Sangsari |
| 2007/0156112 | A1 | 7/2007 | Walsh |
| 2007/0167904 | A1 | 7/2007 | Zinger et al. |
| 2007/0191760 | A1 | 8/2007 | Iguchi et al. |
| 2007/0191764 | A1 | 8/2007 | Zihlmann |
| 2007/0191767 | A1 | 8/2007 | Hennessy et al. |
| 2007/0219483 | A1 | 9/2007 | Kitani et al. |
| 2007/0244461 | A1 | 10/2007 | Fangrow |
| 2007/0244462 | A1 | 10/2007 | Fangrow |
| 2007/0244463 | A1 | 10/2007 | Warren et al. |
| 2007/0249995 | A1 | 10/2007 | Van Manen |
| 2007/0255202 | A1 | 11/2007 | Kitani et al. |
| 2007/0265574 | A1 | 11/2007 | Tennican et al. |
| 2007/0265581 | A1 | 11/2007 | Funamura et al. |
| 2007/0270778 | A9 | 11/2007 | Zinger et al. |
| 2007/0287953 | A1 | 12/2007 | Ziv et al. |
| 2007/0299404 | A1 | 12/2007 | Katoh et al. |
| 2008/0009789 | A1 | 1/2008 | Zinger et al. |
| 2008/0009822 | A1 | 1/2008 | Enerson |
| 2008/0172024 | A1 | 7/2008 | Yow |
| 2008/0249479 | A1 | 10/2008 | Zinger et al. |
| 2008/0249498 | A1 | 10/2008 | Fangrow |
| 2008/0287905 | A1 | 11/2008 | Hiejima et al. |
| 2008/0294100 | A1 | 11/2008 | de Costa et al. |
| 2008/0306439 | A1 | 12/2008 | Nelson et al. |
| 2008/0312634 | A1 | 12/2008 | Helmerson et al. |
| 2009/0012492 | A1 | 1/2009 | Zihlmann |
| 2009/0082750 | A1 | 3/2009 | Denenburg et al. |
| 2009/0143758 | A1 | 6/2009 | Okiyama |
| 2009/0177177 | A1 | 7/2009 | Zinger et al. |
| 2009/0177178 | A1 | 7/2009 | Pedersen |
| 2009/0187140 | A1 | 7/2009 | Racz |
| 2009/0216212 | A1 | 8/2009 | Fangrow, Jr. |
| 2009/0267011 | A1 | 10/2009 | Hatton et al. |
| 2009/0299325 | A1 | 12/2009 | Vedrine et al. |
| 2009/0326506 | A1 | 12/2009 | Hasegawa et al. |
| 2010/0010443 | A1 | 1/2010 | Morgan et al. |
| 2010/0022985 | A1 | 1/2010 | Sullivan et al. |
| 2010/0030181 | A1 | 2/2010 | Helle et al. |
| 2010/0036319 | A1 | 2/2010 | Drake et al. |
| 2010/0076397 | A1 | 3/2010 | Reed et al. |
| 2010/0087786 | A1 | 4/2010 | Zinger et al. |
| 2010/0137827 | A1 | 6/2010 | Warren et al. |
| 2010/0168712 | A1 | 7/2010 | Tuckwell et al. |
| 2010/0179506 | A1 | 7/2010 | Shemesh et al. |
| 2010/0204670 | A1 | 8/2010 | Kraushaar et al. |
| 2010/0241088 | A1 | 9/2010 | Ranalletta et al. |
| 2010/0274184 | A1 | 10/2010 | Chun |
| 2010/0286661 | A1 | 11/2010 | Raday et al. |
| 2010/0312220 | A1 | 12/2010 | Kalitzki |
| 2011/0054440 | A1 | 3/2011 | Lewis |
| 2011/0224640 | A1 | 9/2011 | Kuhn et al. |
| 2011/0230856 | A1 | 9/2011 | Kyle et al. |
| 2011/0264069 | A1 | 10/2011 | Bochenko |
| 2011/0276007 | A1 | 11/2011 | Denenburg |
| 2011/0319827 | A1 | 12/2011 | Leinsing et al. |
| 2012/0022469 | A1 | 1/2012 | Alpert |
| 2012/0053555 | A1 | 3/2012 | Ariagno et al. |
| 2012/0059346 | A1 | 3/2012 | Sheppard et al. |
| 2012/0078214 | A1 | 3/2012 | Finke et al. |
| 2012/0123382 | A1 | 5/2012 | Kubo |
| 2012/0184938 | A1 | 7/2012 | Lev et al. |
| 2012/0215182 | A1 | 8/2012 | Mansour et al. |
| 2012/0220977 | A1 | 8/2012 | Yow |
| 2012/0220978 | A1 | 8/2012 | Lev et al. |
| 2012/0265163 | A1 | 10/2012 | Cheng et al. |
| 2012/0296307 | A1 | 11/2012 | Holt et al. |
| 2012/0310203 | A1 | 12/2012 | Khaled et al. |
| 2013/0053814 | A1 | 2/2013 | Mueller-Beckhaus et al. |
| 2013/0096493 | A1 | 4/2013 | Kubo et al. |
| 2013/0199669 | A1 | 8/2013 | Moy et al. |
| 2013/0289530 | A1 | 10/2013 | Wyatt et al. |

FOREIGN PATENT DOCUMENTS

| | | | |
|---|---|---|---|
| DE | 19504413 | A1 | 8/1996 |
| DE | 202004012714 | U1 | 11/2004 |
| DE | 202009011019 | U1 | 12/2010 |
| EP | 0192661 | A1 | 9/1986 |
| EP | 0195018 | A1 | 9/1986 |
| EP | 0258913 | A2 | 3/1988 |
| EP | 0416454 | A2 | 3/1991 |
| EP | 0518397 | A1 | 12/1992 |
| EP | 0521460 | A1 | 1/1993 |
| EP | 0637443 | A1 | 2/1995 |
| EP | 0737467 | A1 | 10/1996 |
| EP | 761562 | A1 | 3/1997 |
| EP | 765652 | A1 | 4/1997 |
| EP | 765853 | A1 | 4/1997 |
| EP | 0806597 | A1 | 11/1997 |
| EP | 0814866 | A1 | 1/1998 |
| EP | 829248 | A2 | 3/1998 |
| EP | 0856331 | A2 | 8/1998 |
| EP | 882441 | A2 | 12/1998 |
| EP | 0887885 | A2 | 12/1998 |
| EP | 897708 | A2 | 2/1999 |
| EP | 0898951 | A2 | 3/1999 |
| EP | 960616 | A2 | 12/1999 |
| EP | 1008337 | A1 | 6/2000 |
| EP | 1029526 | A1 | 8/2000 |
| EP | 1034809 | A1 | 9/2000 |
| EP | 1051988 | A2 | 11/2000 |
| EP | 1323403 | A1 | 7/2003 |
| EP | 1329210 | A1 | 7/2003 |
| EP | 1396250 | A1 | 3/2004 |
| EP | 1454609 | A1 | 9/2004 |
| EP | 1454650 | A1 | 9/2004 |

(56) References Cited

FOREIGN PATENT DOCUMENTS

| | | | |
|---|---|---|---|
| EP | 1498097 | A2 | 1/2005 |
| EP | 1872824 | A1 | 1/2008 |
| EP | 1919432 | A1 | 5/2008 |
| EP | 1930038 | A2 | 6/2008 |
| EP | 2351548 | A1 | 8/2011 |
| EP | 2351549 | A1 | 8/2011 |
| FR | 2029242 | A5 | 10/1970 |
| FR | 2856660 | A1 | 12/2004 |
| FR | 2869795 | A1 | 11/2005 |
| FR | 2931363 | A1 | 11/2009 |
| GB | 1444210 | A | 7/1976 |
| IL | 171662 | | 10/2005 |
| JP | 03-062426 | B | 9/1991 |
| JP | 4329954 | A | 11/1992 |
| JP | 06-050656 | U | 7/1994 |
| JP | H08-000710 | A | 1/1996 |
| JP | 09-104460 | A | 4/1997 |
| JP | 09-104461 | A | 4/1997 |
| JP | 10-118158 | A | 5/1998 |
| JP | H10-504736 | A | 5/1998 |
| JP | 11503627 | T | 3/1999 |
| JP | 11-319031 | A | 11/1999 |
| JP | 2000-508934 | A | 7/2000 |
| JP | 2000-237278 | A | 9/2000 |
| JP | 2001-505083 | A | 4/2001 |
| JP | 2002-035140 | A | 2/2002 |
| JP | 2002-516160 | A | 6/2002 |
| JP | 2002-355318 | A | 12/2002 |
| JP | 2003-033441 | A | 2/2003 |
| JP | 2003-102807 | A | 4/2003 |
| JP | 2004-097253 | A | 4/2004 |
| JP | 2004-522541 | A | 7/2004 |
| WO | 9403373 | A1 | 2/1994 |
| WO | 9507066 | A1 | 3/1995 |
| WO | 9600053 | A1 | 1/1996 |
| WO | 9629113 | A1 | 9/1996 |
| WO | 9736636 | A1 | 10/1997 |
| WO | 9832411 | A1 | 7/1998 |
| WO | 9837854 | A1 | 9/1998 |
| WO | 9961093 | A1 | 12/1999 |
| WO | 0128490 | A1 | 4/2001 |
| WO | 0130425 | A1 | 5/2001 |
| WO | 0132524 | A1 | 5/2001 |
| WO | 0160311 | A1 | 8/2001 |
| WO | 0191693 | A2 | 12/2001 |
| WO | 0209797 | A1 | 2/2002 |
| WO | 0236191 | A2 | 5/2002 |
| WO | 02089900 | A1 | 11/2002 |
| WO | 03051423 | A2 | 6/2003 |
| WO | 03079956 | A1 | 10/2003 |
| WO | 2004041148 | A1 | 5/2004 |
| WO | 2005002492 | A1 | 1/2005 |
| WO | 2005041846 | A2 | 5/2005 |
| WO | 2005105014 | A2 | 11/2005 |
| WO | 2006099441 | A2 | 9/2006 |
| WO | 2007015233 | A1 | 2/2007 |
| WO | 2007017868 | A1 | 2/2007 |
| WO | 2007052252 | A1 | 5/2007 |
| WO | 2007105221 | A1 | 9/2007 |
| WO | 2009026443 | A2 | 2/2009 |
| WO | 2009029010 | A1 | 3/2009 |
| WO | 2009038860 | A1 | 3/2009 |
| WO | 2009038860 | A2 | 3/2009 |
| WO | 2009040804 | A2 | 4/2009 |
| WO | 2009087572 | A1 | 7/2009 |
| WO | 2009093249 | A1 | 7/2009 |
| WO | 2009112489 | A1 | 9/2009 |
| WO | 2009146088 | A1 | 12/2009 |
| WO | 2011058545 | A1 | 5/2011 |
| WO | 2011058548 | A1 | 5/2011 |
| WO | 2011077434 | A1 | 6/2011 |
| WO | 2011104711 | A1 | 9/2011 |
| WO | 2012143921 | A1 | 10/2012 |
| WO | 2013127813 | A1 | 9/2013 |

OTHER PUBLICATIONS

U.S. Appl. No. 29/478,723 by Lev, filed Jan. 8, 2014.
U.S. Appl. No. 29/478,726 by Lev, filed Jan. 8, 2014.
Office Action issued Jan. 2, 2014 in U.S. Appl. No. 13/505,881 by Lev.
Office Action issued Mar. 6, 2012 in U.S. Appl. No. 12/678,928.
Int'l Search Report issued Feb. 3, 2011 in Int'l Application No. PCT/IL2010/000777; Written Opinion.
Int'l Search Report issued Mar. 17, 2011 in Int'l Application No. PCT/IL2010/000854; Written Opinion.
Int'l Search Report issued Mar. 17, 2011 in Int'l Application No. PCT/IL2010/000915; Written Opinion.
U.S. Appl. No. 13/505,790 by Lev, filed May 3, 2012.
U.S. Appl. No. 13/505,881 by Lev, filed May 3, 2012.
U.S. Appl. No. 13/522,410 by Lev, filed Jul. 16, 2012.
U.S. Appl. No. 13/576,461 by Lev, filed Aug. 1, 2012.
Office Action issued Jun. 14, 2012 in U.S. Appl. No. 29/376,980.
Office Action issued Jun. 15, 2012 in U.S. Appl. No. 29/413,170.
Office Action issued Jun. 21, 2012 in U.S. Appl. No. 12/596,167.
Alaris Medical Systems Product Brochure, 4 pages, Issue 1, Oct. 11, 1999.
Smart Site Needle-Free Systems, Alaris Medical Systems Webpage, 4 pages, Feb. 2006.
Photographs of Alaris Medical Systems SmartSite.RTM. device, 5 pages, 2002.
Non-Vented Vial Access Pin with ULTRASITE.RTM. Valve, B. Braun Medical, Inc. website and product description, 3 pages, Feb. 2006.
Int'l Search Report issued Aug. 16, 2012 in Int'l Application No. PCT/IL2012/000164.
U.S. Appl. No. 29/438,134 by Lev, filed Nov. 27, 2012.
U.S. Appl. No. 29/438,141 by Gilboa, filed Nov. 27, 2012.
Int'l Search Report issued Jan. 22, 2013 in Int'l Application No. PCT/IL2012/000354.
Int'l Search Report issued Mar. 18, 2013 in Int'l Application No. PCT/IL2012/050516.
Office Action issued Apr. 2, 2013 in U.S. Appl. No. 13/505,790.
Int'l Search Report and Written Opinion issued Mar. 6, 2012 in Int'l Application No. PCT/IL2011/000834.
U.S. Appl. No. 13/883,289 by Lev, filed May 3, 2013.
Int'l Search Report & Written Opinion issued on Mar. 7, 2012 in Int'l Application No. PCT/IL2011/000829.
U.S. Appl. No. 13/884,981 by Denenburg, filed May 13, 2013.
Office Action issued May 31, 2013 in U.S. Appl. No. 13/505,790.
Int'l Search Report issued Jun. 5, 2013 in Int'l Application No. PCT/IL2012/050407.
Int'l Search Report issued Jun. 19, 2013 in Int'l Application No. PCT/IL201/050167.
Int'l Search Report issued Jul. 1, 2013 in Int'l Application No. PCT/IL2013/050180.
Int'l Search Report issued Jul. 31, 2103 in Int'l Application No. PCT/IL2013/050313.
Int'l Search Report issued Jul. 26, 2013 in Int'l Application No. PCT/IL2013/050316.
English translation of an Office Action issued Jun. 19, 2013 in JP Application No. 2012-531551.
Office Action issued Aug. 20, 2013 in U.S. Appl. No. 13/576,461 by Lev.
International Search Report Issued Jan. 23, 2007 in Int'l Application No. PCT/IL/2006/001228.
IV disposables sets catalogue, Cardinal Health, Alaris® products, SmartSite® access devices and accessories product No. 10013365, SmartSite add-on bag access device with spike adapter and needle-free valve bag access port, pp. 1-5, Fall edition (2007).
Office Action Issued Jun. 8, 2010 in U.S. Appl. No. 12/112,490 by Zinger.
Office Action issued 09/28/10 in U.S. Appl. No. 12/112,490 by Zinger.
Article with picture of West Pharmaceutical Services' Vial2Bag Needleless System, [on-line]; ISIPS Newsletter, Oct. 26, 2007]; retrieved from Internet Feb. 16, 2010]; URL:<http://www.isips.org/reports/ISIPS_Newsletter_October_26_2007. html.> (7 pages. see pp. 5-6).

(56) References Cited

OTHER PUBLICATIONS

Office Action issued Jun. 15, 2011 in JP Application No. 2008-538492.
Translation of Office Action issued Jun. 18, 2012 in JP Application No. 2008-538492.
Translation of Office Action issued Apr. 15, 2013 in JP Application No. 2008-538492.
Office Action issued Jul. 13, 2012 in U.S. Appl. No. 12/112,490 by Zinger.
Office Action issued Jan. 23, 2013 in U.S. Appl. No. 12/112,490 by Zinger.
Int'l Preliminary Report on Patentability issued May 6, 2008 in Int'l Application No. PCT/IL2006/001228.
Written Opinion issued Aug. 16, 2012 in Int'l Application No. PCT/IL2012/000164.
English translation of an Office Action issued Sep. 10, 2013 in JP Application No. 2012-554468.
Int'l Search Report issued Jun. 19, 2013 in Int'l Application No. PCT/IL2013/050167.
English translation of an Office Action issued Jul. 26, 2013 in JP Application No. 2012-538464.
Drug Administration Systems product information sheets; http://www.westpharma.com/eu/en/products/Pages/Vial2Bag.aspx; pp. 1-3 (admitted prior art as of at least Apr. 1, 2010).
Office Action issued Feb. 13, 2014 in U.S. Appl. No. 13/884,981 by Denenburg.
U.S. Appl. No. 14/345,094 by Lev, filed Mar. 14, 2014.
Grifols Vial Adapter Product Literature, 2 pages, Jan. 2002.
Novel Transfer, Mixing and Drug Delivery Systems, MOP Medimop Medical Projects Ltd. Catalog, 4 pages, Rev. 4, 2004.
Office Action Issued Oct. 6, 2003 in U.S. Appl. No. 10/062,796.
Office Action Issued Feb. 22, 2005 in U.S. Appl. No. 10/062,796.
Office Action Issued Oct. 5, 2005 in U.S. Appl. No. 10/062,796.
Office Action Issued Feb. 20, 2009 in U.S. Appl. No. 11/694,297.
Int'l Search Report Issued Dec. 6, 2006 in Int'l Application No. PCT/IL2006/000912.
Int'l Preliminary Report on Patentability Issued Dec. 4, 2007 in Int'l Application No. PCT/IL2006/000912.
http://www.westpharma.com/en/products/Pages/Mixject.aspx (admitted prior art).
http://www.westpharma.com/SiteCollectionDocuments/Recon/mixject%20product%20sheet.pdf; Mixject product information sheet pp. 1. (admitted prior art).
Int'l Search Report Issued Jul. 27, 2007 in Int'l Application No. PCT/IL2007/000343.
Int'l Preliminary Report on Patentability Issued Jun. 19, 2008 in Int'l Application No. PCT/IL2007/000343.
Int'l Search Report Issued Mar. 27, 2009 in Int'l Application No. PCT/US2008/070024.
Int'l Search Report Issued Oct. 17, 2005 in Int'l Application No. PCT/IL2005/000376.
Int'l Preliminary Report on Patentability Issued Jun. 19, 2006 in Int'l Application No. PCT/IL2005/000376.
Written Opinion of ISR Issued in Int'l Application No. PCT/IL2005/000376.
Int'l Search Report Issued Aug. 25, 2008 in Int'l Application No. PCT/IL2008/000517.
Written Opinion of the ISR Issued Oct. 17, 2009 in Int'l Application No. PCT/IL08/00517.
Int'l Preliminary Report on Patenability Issued Oct. 20, 2009 in Int'l Application No. PCT/IL2008/000517.
Written Opinion of the Int'l Searching Authority Issued Oct. 27, 2008 in Int'l Application No. PCT/US2008/070024.
Int'l Search Report Issued Mar. 12, 2009 in Int'l Application No. PCT/IL2008/001278.
Office Action Issued Jan. 20, 2010 in JP Application No. 2007-510229.
Office Action Issued Apr. 20, 2010 in U.S. Appl. No. 11/997,569.
Int'l Search Report dated Nov. 20, 2006 in Int'l Application No. PCT/IL2006/000881.
Office Action Issued May 27, 2010 in U.S. Appl. No. 11/559,152.
Decision to Grant mailed Apr. 12, 2010 in EP Application No. 08738307.1.
Office Action issued Jun. 1, 2010 in U.S. Appl. No. 11/568,421.
Office Action issued Nov. 12, 2010 in U.S. Appl. No. 29/334,697.
The MixJect transfer system, as shown in the article, "Advanced Delivery Devices," Drug Delivery Technology Jul./Aug. 2007 vol. 7 No. 7 [on-line]. [Retrieved from Internet May 14, 2010.] URL: <http://www.drugdeiverytech-online.com/drugdelivery/200707/?pg=28pg28>. (3 pages).
Publication date of Israeli Patent Application 186290 [on-line]. ]Retrieved from Internet May 24, 2010]. URL:<http://www.ilpatsearch.justrice.gov.il/UI/Requestslist.aspx>. (1 page).
Int'l Search Report issued Nov. 25, 2010 in Int'l Application No. PCT/IL2010/000530.
Office Action issued Feb. 7, 2011 in U.S. Appl. No. 12/783,194.
Office Action issued Dec. 20, 2010 in U.S. Appl. No. 12/063,176.
Office Action issued Dec. 13, 2010 in U.S. Appl. No. 12/293,122.
Office Action issued Nov. 29, 2010 in U.S. Appl. No. 11/568,421.
Office Action issued Dec. 23, 2010 in U.S. Appl. No. 29/334,696.
Int'l Search Report issued on Mar. 17, 2011 in Int'l Application No. PCT/IL2010/000854.
http://www.knovel.com/web/portal/browse/display?_EXT_KNOVEL_DISPLAY_bookid=1023&VerticalID=0 [retrieved on Feb. 9, 2011].
Int'l Search Report issued on Mar. 17, 2011 in Int'l Application No. PCT/IL2010/00915.
Office Action Issued May 12, 2011 in U.S. Appl. No. 12/063,176.
Office Action issued Jul. 11, 2011 in U.S. Appl. No. 12/293,122.
Int'l Search Report issued Jul. 12, 2011 in Int'l Application No. PCT/IL2011/000187.
Int'l Search Report issued Jul. 12, 2011 in Int'l Application No. PCT/IL2011/000186.
Office Action issued Aug. 3, 2011 in JP Application No. 2008-525719.
Int'l Search Report issued Oct. 7, 2011 in Int'l Application No. PCT/IL2011/000511.
Int'l Search Report issued Mar. 6, 2012 in Int'l Application No. PCT/IL2011/000834; Written Opinion.
Office Action issued Mar. 1, 2012 in JP Application No. 2007-510229.
Int'l Search Report issued Mar. 7, 2012 in Int'l Application No. PCT/IL2011/000829; Written Opinion.
Office Action issued Mar. 13, 2012 in CA Application No. 2,563,643.
Office Action issued Mar. 1, 2012 in CN Application No. 2008801108283.4.

* cited by examiner

LIQUID DRUG TRANSFER ASSEMBLY

CROSS-REFERENCE TO RELATED APPLICATIONS

This application is a Section 371 of International Application No. PCT/IL2012/000164, filed Apr. 17, 2012, which was published in the English language on Oct. 26, 2012, under International Publication No. WO 2012/143921 A1 and the disclosure of which is incorporated herein by reference.

BACKGROUND OF THE INVENTION

1. Field of the Invention

The invention relates to liquid drug transfer assemblies for liquid drug reconstitution and administration purposes.

2. Background of the Invention

Dual ended dual lumen linear transfer spikes are typically employed for gravitational liquid transfer from a liquid vial containing a liquid component to a drug vial containing a drug component for forming liquid drug contents in the drug vial for administration purposes and simultaneous air transfer from the drug vial to the liquid vial for pressure equalization. The transfer spikes have exposed drug vial stopper and liquid vial stopper puncturing members with sharp vial stopper puncturing tips which pose a danger to users in general and home users in particular. Moreover, it is difficult to accurately center and correctly insert a transfer spike on a vial stopper to ensure that the transfer spike correctly punctures same for flow communication with a vial interior. Furthermore, a user has to manually remove the transfer spike and use other means, for example, a needle, to withdraw the liquid drug contents which can be cumbersome action and lead to a needle stick injury and contamination of the liquid drug contents.

BRIEF SUMMARY OF THE INVENTION

The invention relates to liquid drug transfer assemblies for use with a drug vial including a drug vial bottle containing a drug component and having a drug vial opening stopped by a drug vial stopper. The drug component is typically a powdered drug component but can equally be a liquid drug component of different viscosities. The liquid drug transfer assemblies include a drug vial stopper puncturing member and a drug vial adapter having a substantially cylindrical drug vial adapter skirt with a drug vial adapter top surface, a drug vial adapter body portion for telescopically slidingly receiving a drug vial opening therein and a drug vial adapter skirt margin. The drug vial adapter top surface is formed with an upright drug vial adapter port and a downward depending drug vial adapter sleeve opposite the drug vial adapter port and in flow communication therewith. The drug vial adapter skirt can be optionally formed from a multitude of at least two drug vial adapter flex members. The drug vial adapter skirt can optionally include inwardly directed protrusions for snap fitting onto a drug vial opening. The drug vial adapter skirt margin can be optionally outwardly flared with respect to the drug vial adapter body portion for assisting in guidance of the drug vial adapter on a drug vial. The drug vial adapter is slidingly disposed on the drug vial stopper puncturing member such that its drug vial stopper puncturing member protrudes beyond the drug vial adapter sleeve in a set-up position of the liquid drug transfer assembly.

The liquid drug transfer assembly is mounted on a drug vial such that the drug vial stopper puncturing member punctures the drug vial stopper to form a throughgoing puncture bore and the drug vial adapter sleeve lines the puncture bore through the drug vial stopper. The drug vial adapter sleeve stops the drug vial stopper from sealing itself on withdrawal of the drug vial stopper puncturing member therefrom, thereby maintaining continuous flow communication between the drug vial bottle and the drug vial adapter port. The drug vial adapter sleeve also prevents remnants of the drug vial stopper contaminating liquid drug contents in a drug vial. Suitable medical devices can be readily mounted on the drug vial adapter port for flow communication with the drug vial bottle. Suitable medical devices include inter alia a needleless syringe, an administration line, and the like.

The drug vial stopper puncturing member can be configured as one end of a dual ended dual lumen linear transfer spike including an opposite liquid vial stopper puncturing member for puncturing a liquid vial stopper of a liquid vial containing a liquid component. The liquid component is typically a diluent but can equally contain an active drug component. Such a dual ended dual lumen linear transfer spike enables simultaneous gravitational liquid transfer from a liquid vial to a drug vial for forming liquid drug contents in a drug vial for administration purposes and air transfer from the drug vial to the liquid vial for pressure equalization purposes.

The dual ended dual lumen linear transfer spike can be integrally formed with a liquid vial adapter for mounting onto a liquid vial. Alternatively, the dual ended dual lumen linear transfer spike can be integrally formed with a liquid drug transfer device for use with a discrete liquid vial adapter for mounting onto a liquid vial thereby forming a triple component liquid drug transfer assembly including the drug vial adapter. The liquid drug transfer device includes a transverse directed spacing collar midway along the dual ended dual lumen linear transfer spike, at least two longitudinal directed drug vial legs and at least two longitudinal directed liquid vial legs oppositely directed to the at least two longitudinal directed drug vial legs. The drug vial legs and the liquid vial legs are employed for centering purposes of their corresponding drug vial stopper puncturing tip and liquid vial stopper puncturing tip with respect to their respective vial stoppers.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In order to understand the invention and to see how it can be carried out in practice, preferred embodiments will now be described, by way of non-limiting examples only, with reference to the accompanying drawings in which similar parts are likewise numbered, and in which:

In the drawings:

FIG. 1 is a pictorial representation of a first preferred embodiment of a liquid drug transfer assembly including a drug vial stopper puncturing member and a drug vial adapter, a blister pack for long term storage of same, a needleless syringe, and a drug vial;

FIG. 2 is an exploded view of FIG. 1's liquid drug transfer assembly;

FIG. 3 is a longitudinal cross section of FIG. 1's liquid drug transfer assembly in its initial ready to use state along line A-A in FIG. 1;

FIG. 4A is a longitudinal cross section of FIG. 1's liquid drug transfer assembly in a set-up position and disposed co-axial with the drug vial ready for snap fitting thereon;

FIG. 4B is a longitudinal cross section of FIG. 1's liquid drug transfer assembly pursuant to an initial downward depression toward the drug vial;

FIG. 4C is a longitudinal cross section of FIG. 1's liquid drug transfer assembly pursuant to complete snap fitting of the drug vial adapter on the drug vial;

FIG. 4D is a longitudinal cross section of FIG. 1's liquid drug transfer assembly pursuant to removal of the drug vial stopper puncturing member;

FIG. 5 is a longitudinal cross section of an alternative embodiment of FIG. 1's liquid drug transfer assembly including a drug vial stopper puncturing member having a liquid drug access port and an in-line filter;

FIG. 6 is a longitudinal cross section of another alternative embodiment of FIG. 1's drug vial adapter including a drug vial adapter sleeve component mounted on its drug vial adapter top surface;

FIG. 7 is a pictorial representation of a second preferred embodiment of a liquid drug transfer assembly including a liquid vial adapter and a drug vial adapter, a blister pack for long term storage of same, a needleless syringe, a drug vial, and a liquid vial;

FIG. 8 is an exploded view of FIG. 7's liquid drug transfer assembly;

Figure 7:
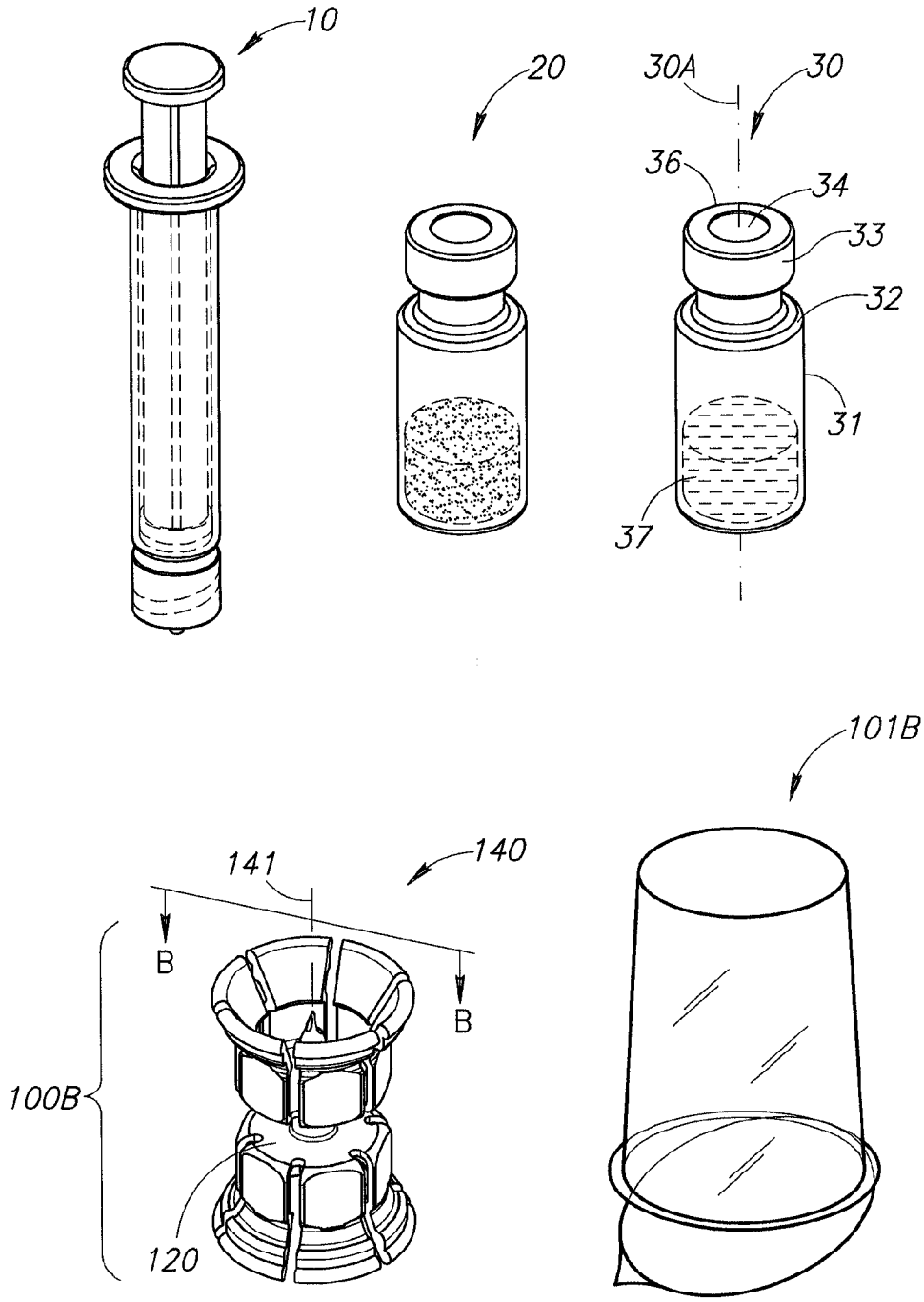
Figure 9:
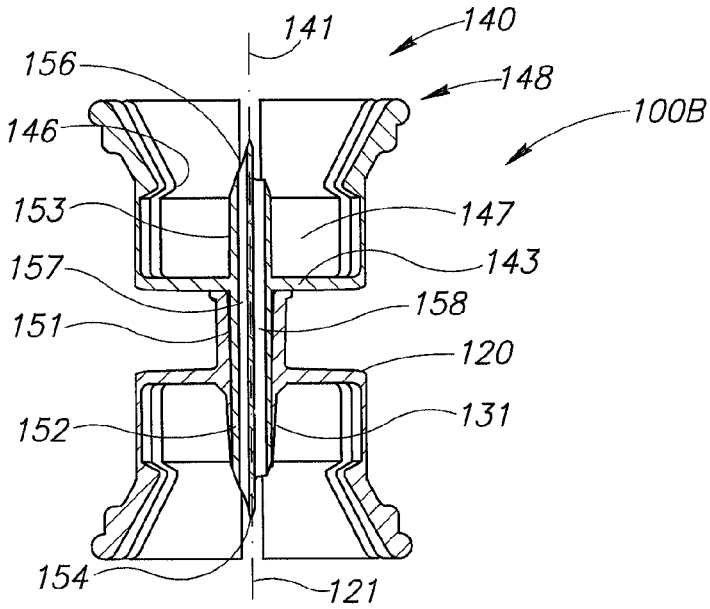
Figure 10A:
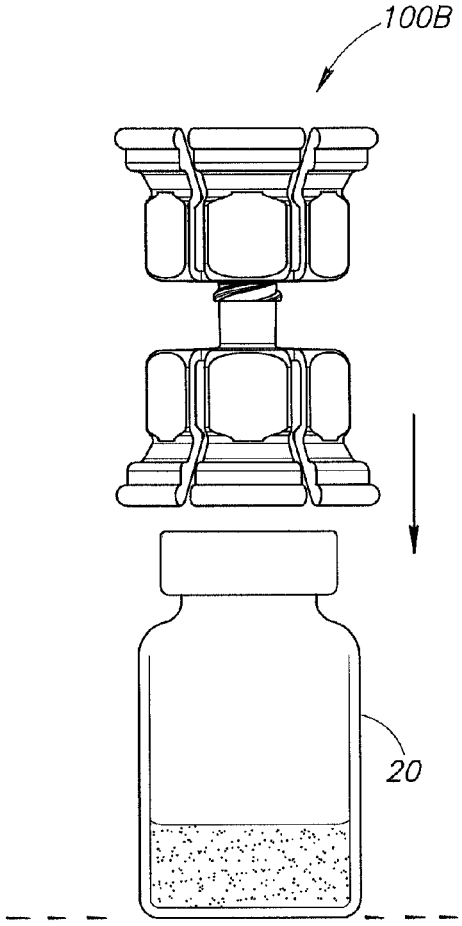
Figure 10B:
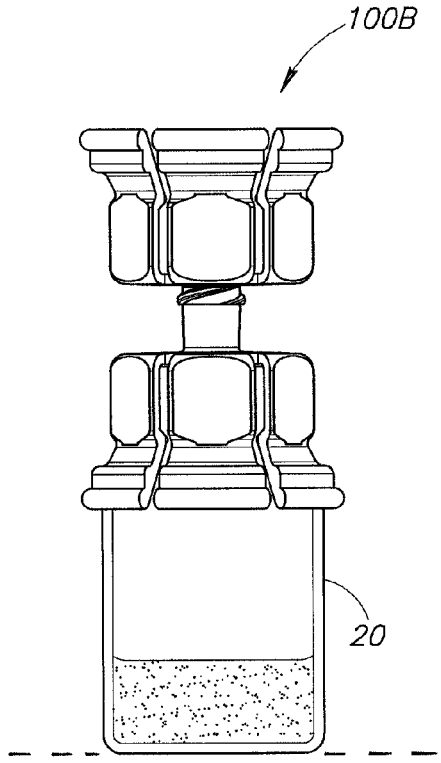
Figure 10C:
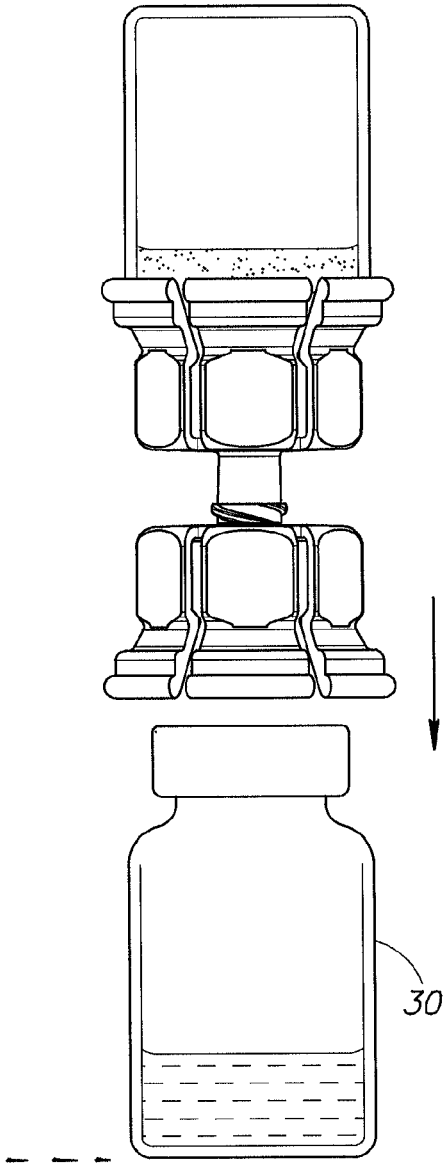
Figure 10D:
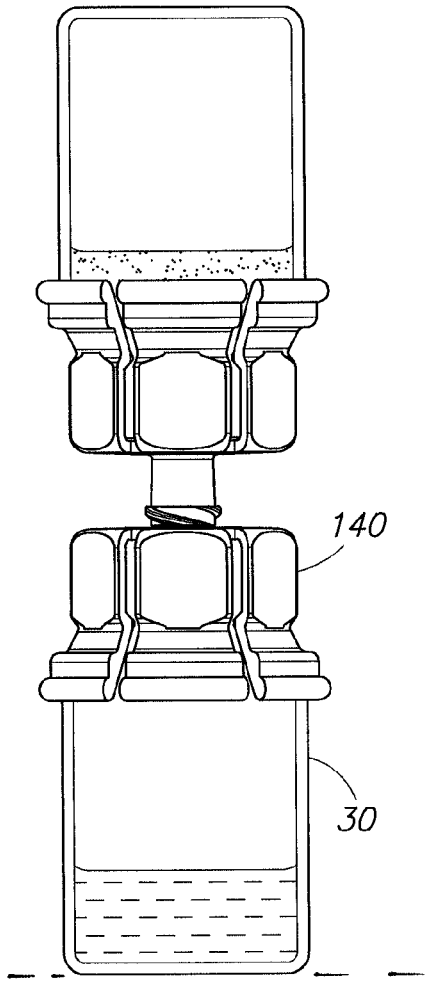
Figure 10G:
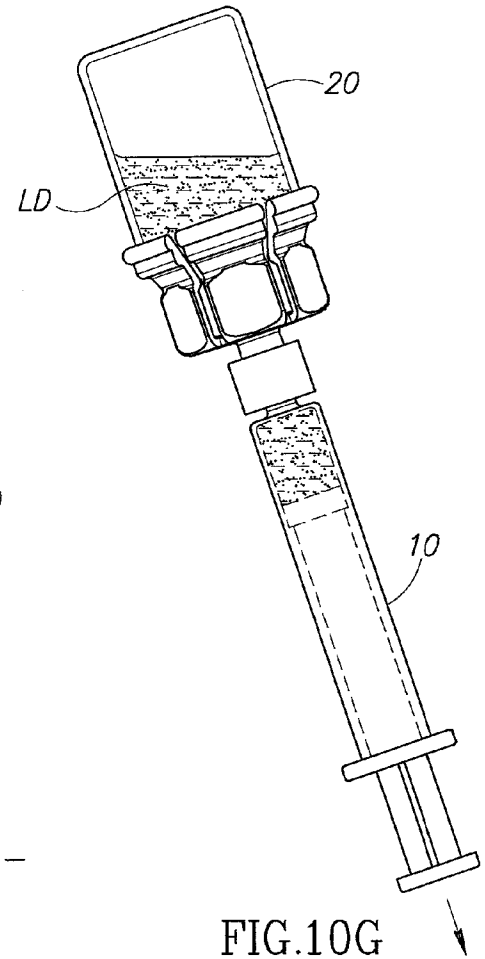
Figure 10F:
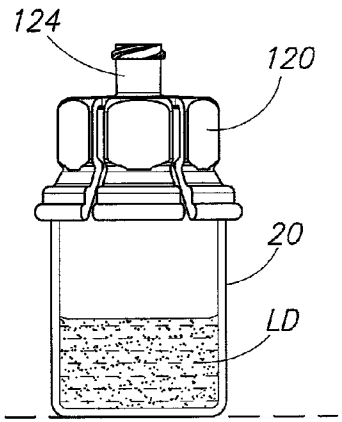
Figure 10E:
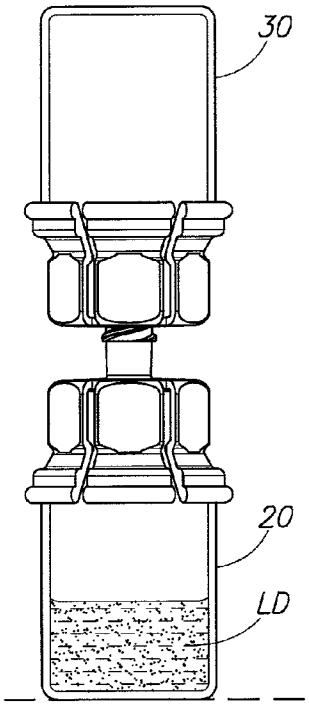
Figure 11:
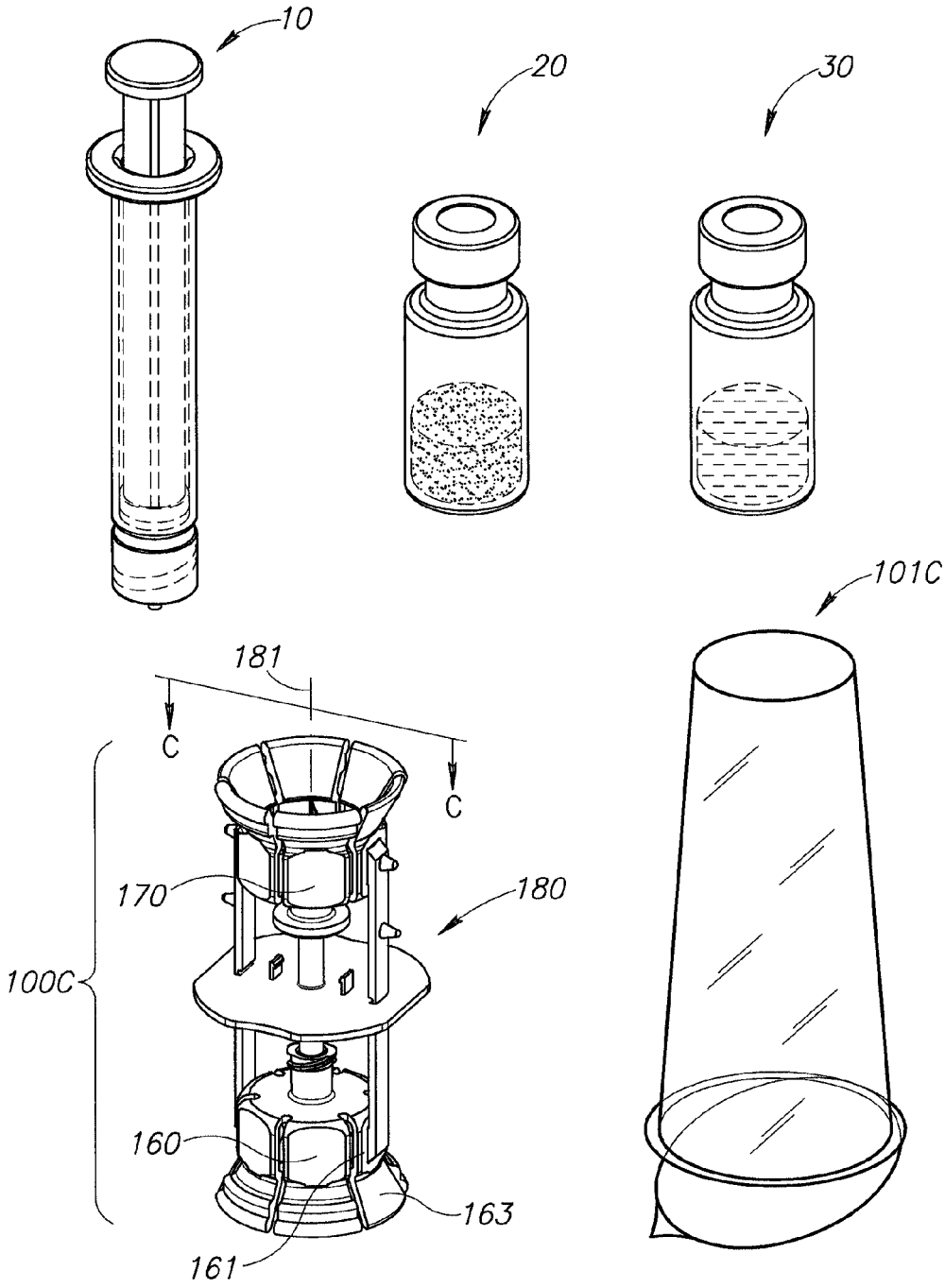
Figure 12:
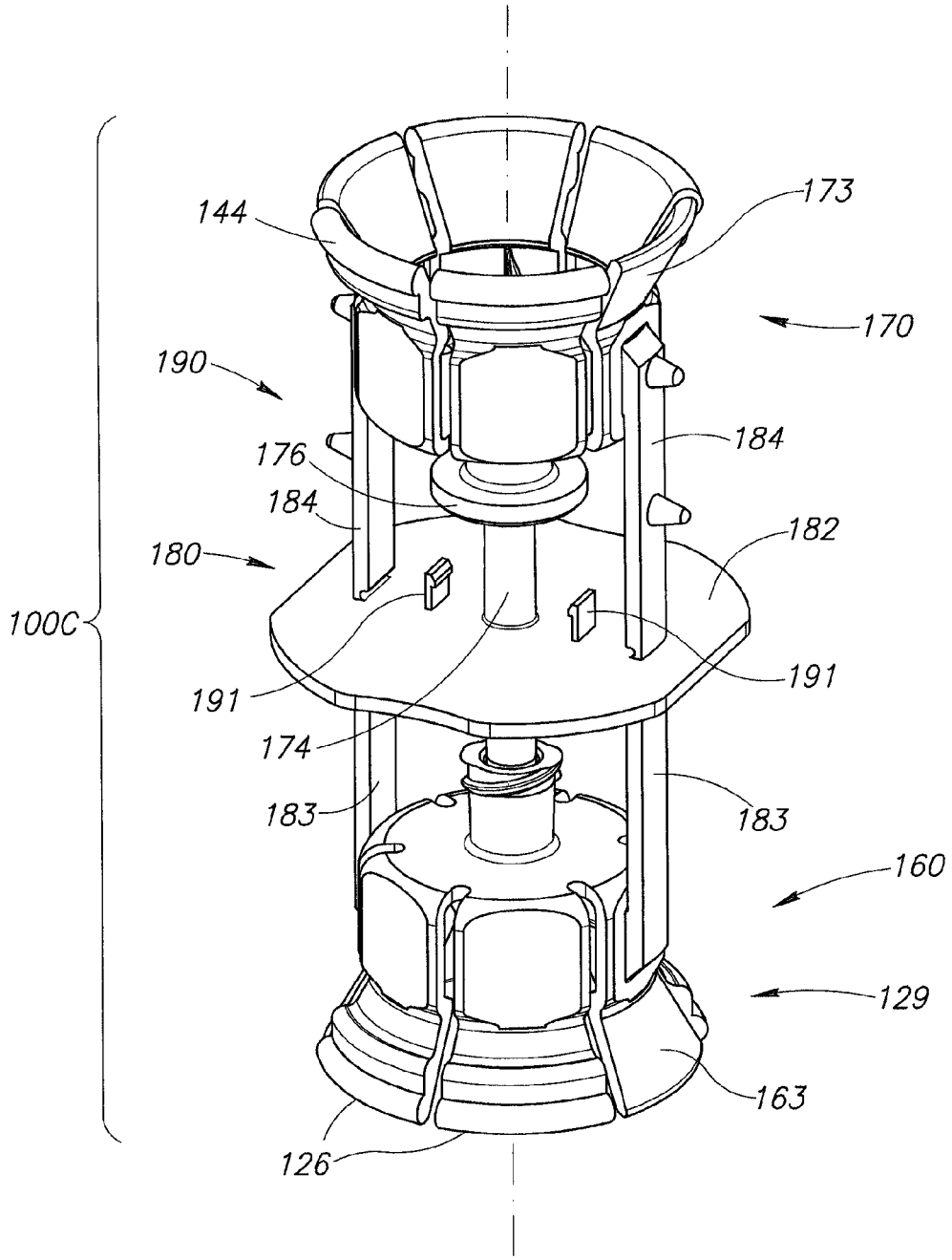
Figure 13:
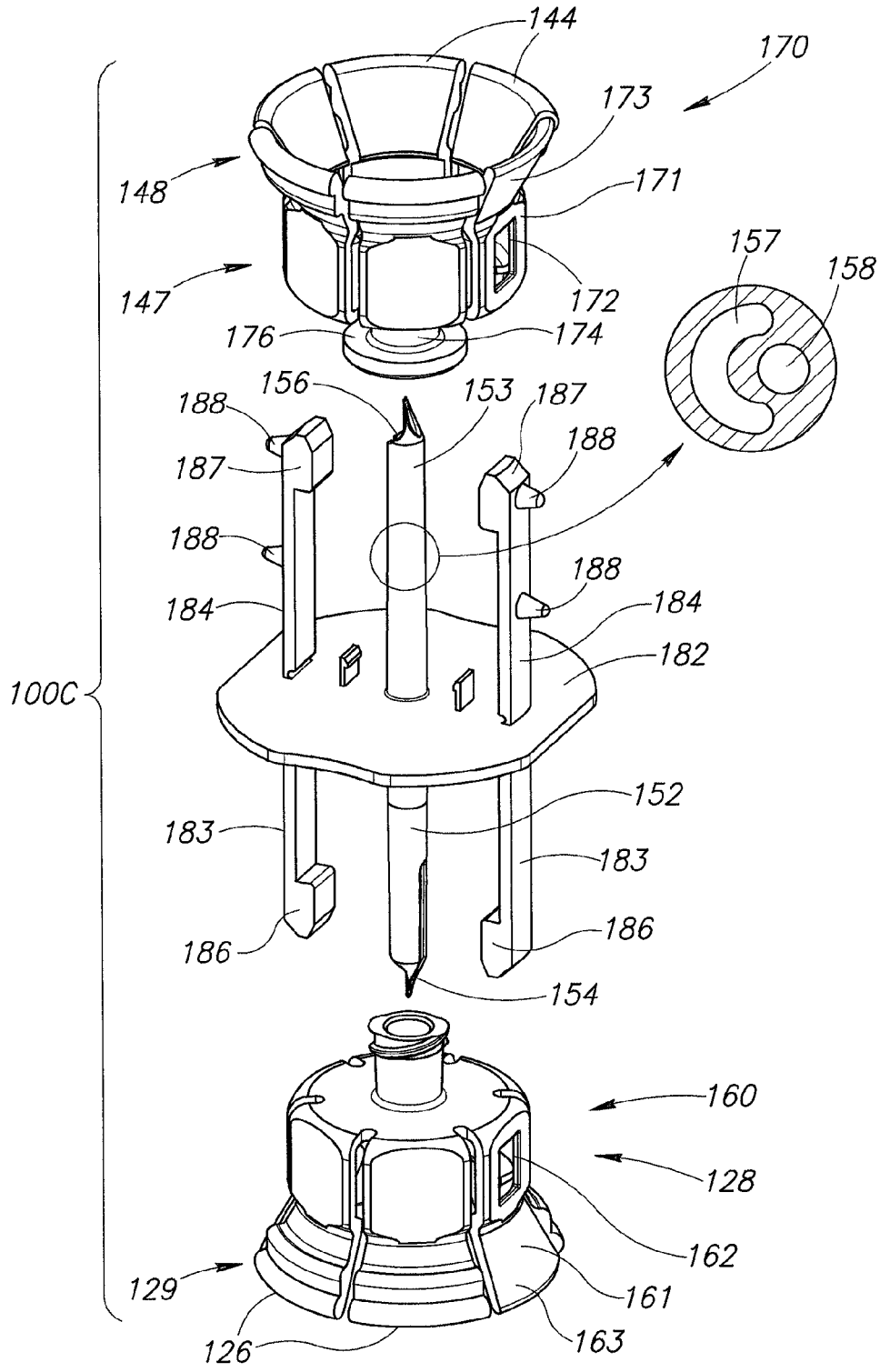
Figure 14:
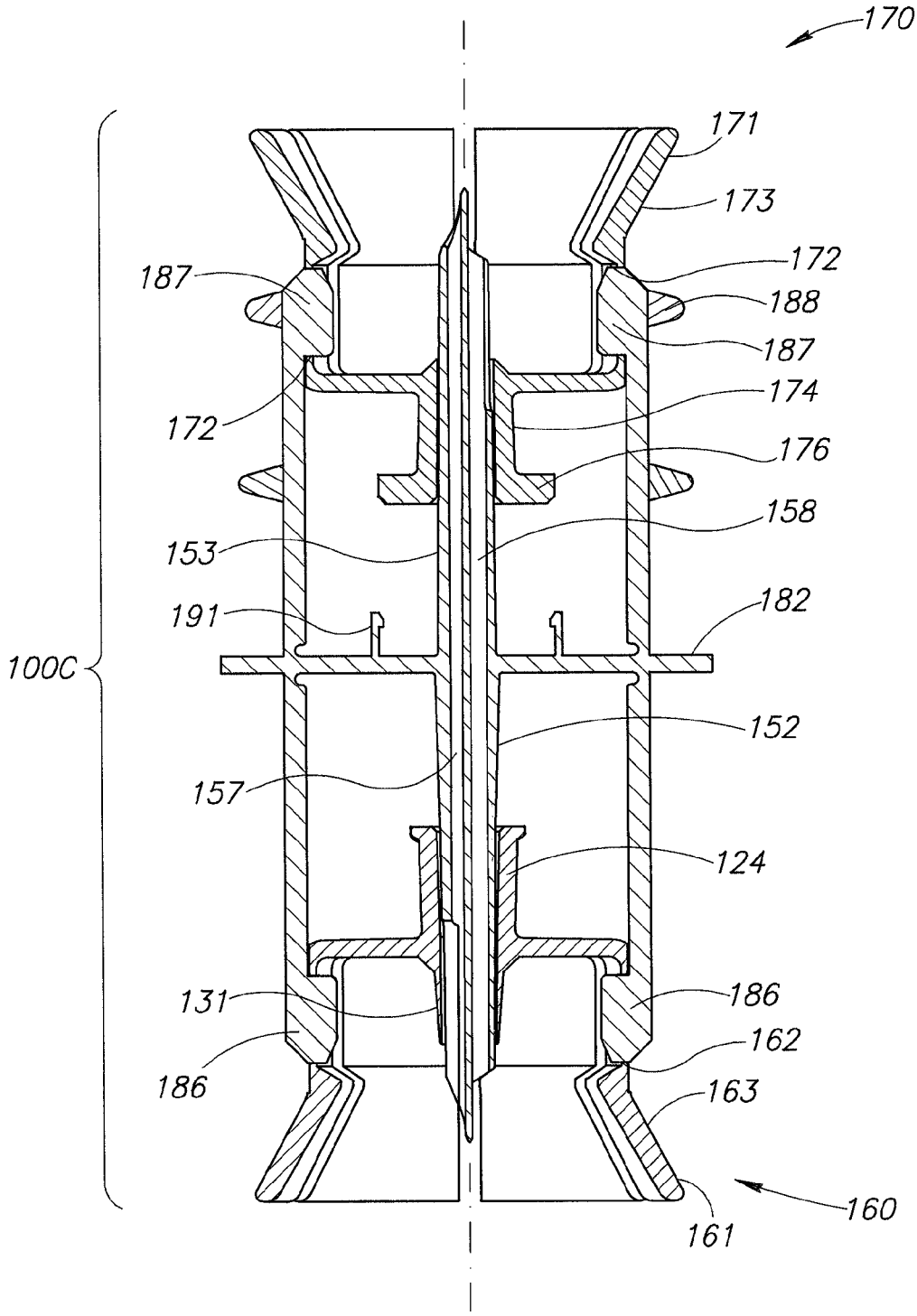
Figure 15A:
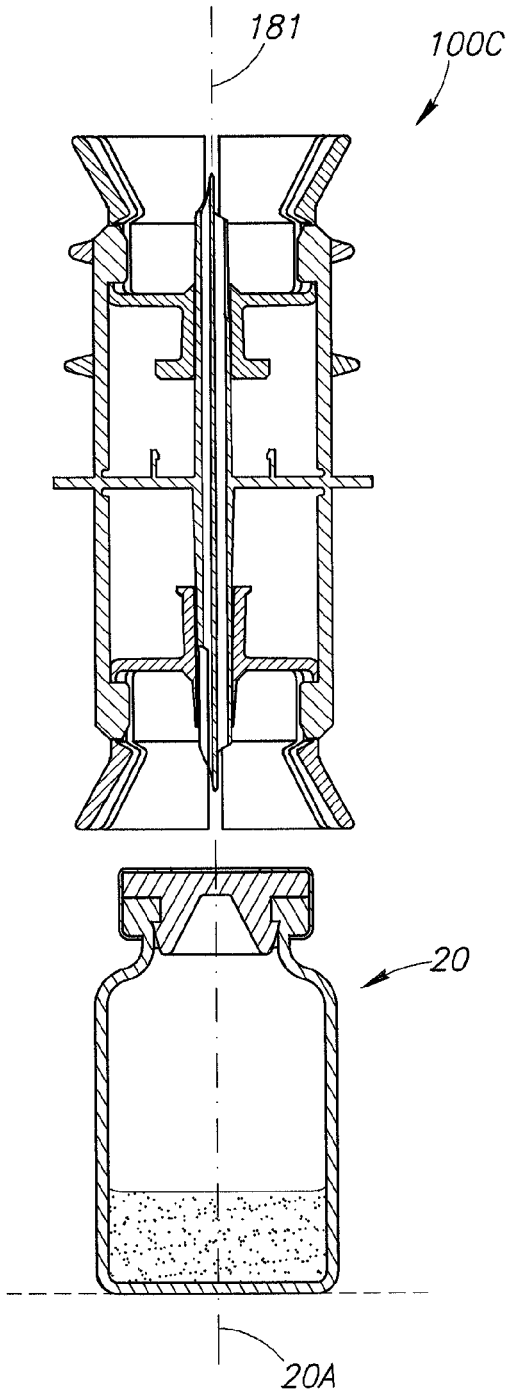
Figure 15B:
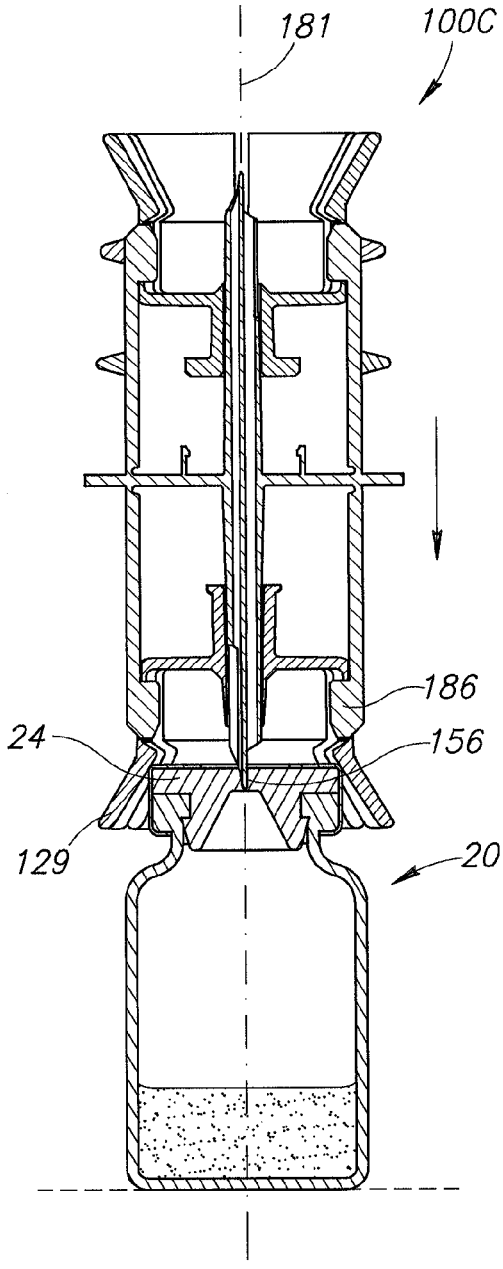
Figure 15C:
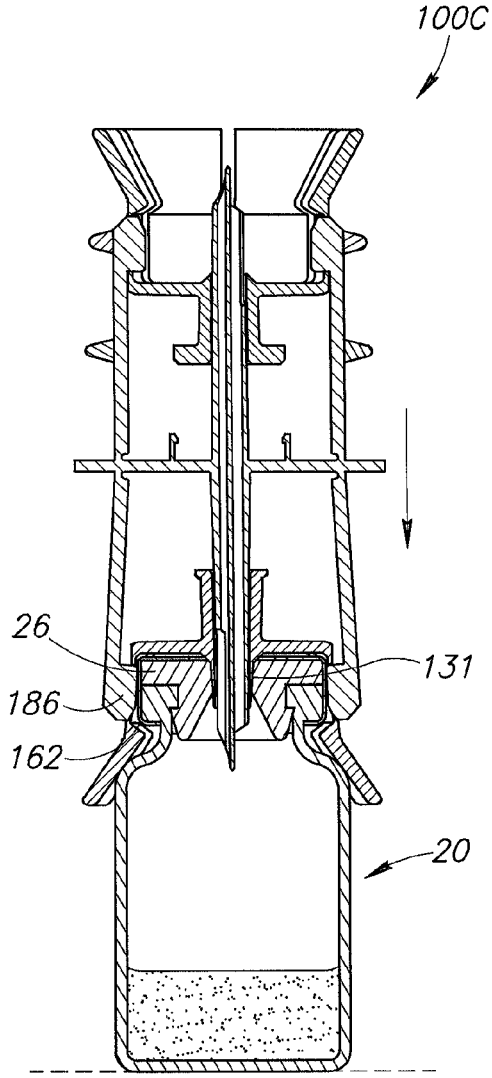
Figure 15D:
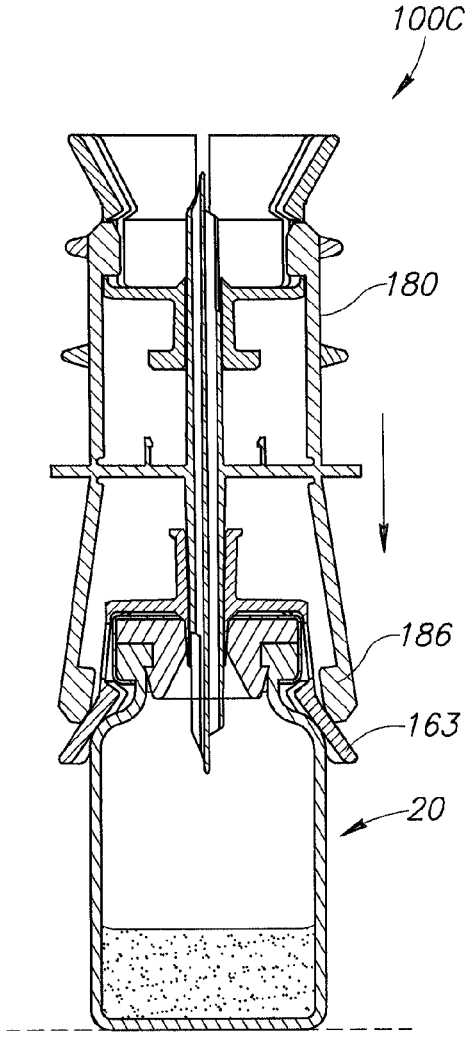
Figure 15E:
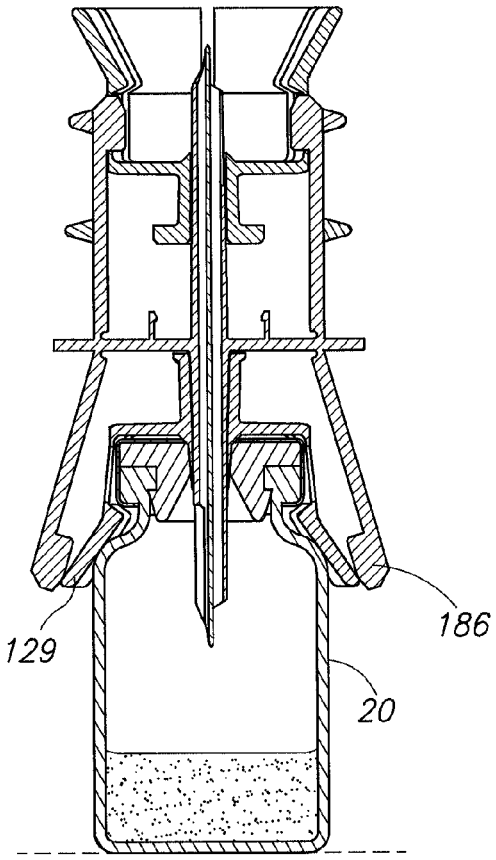
Figure 15F:
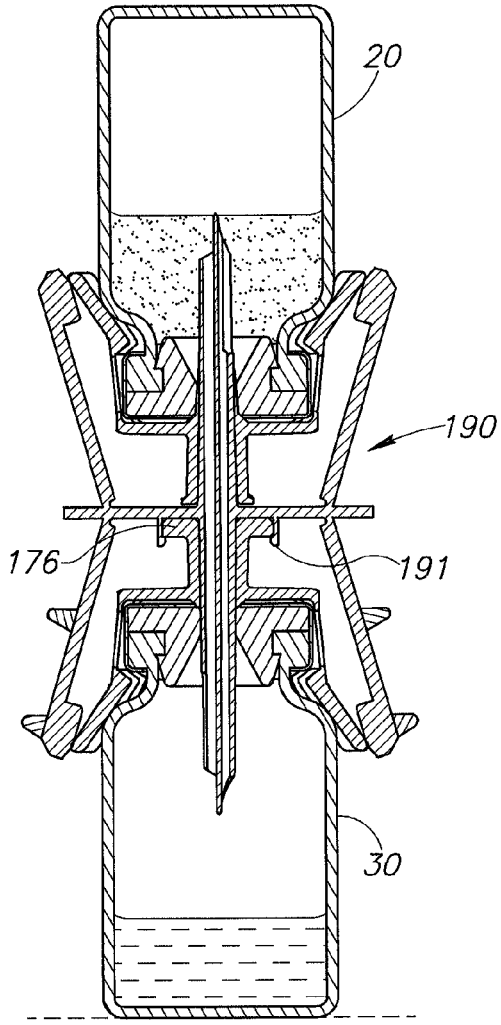
Figure 16A:
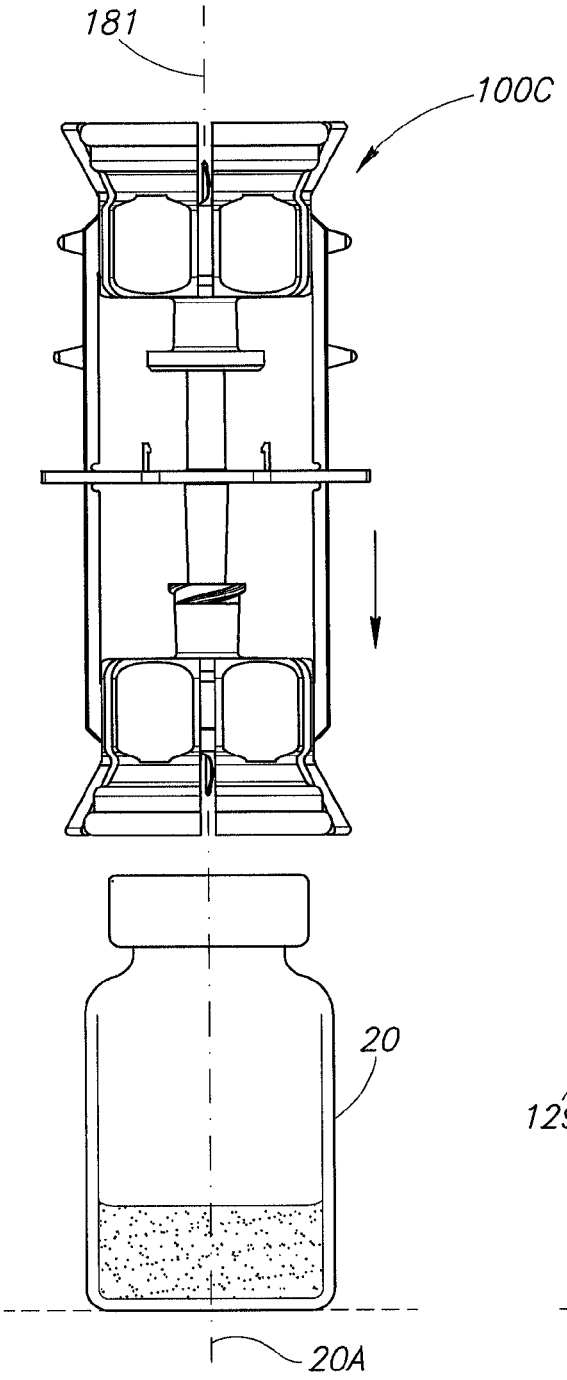
Figure 16B:
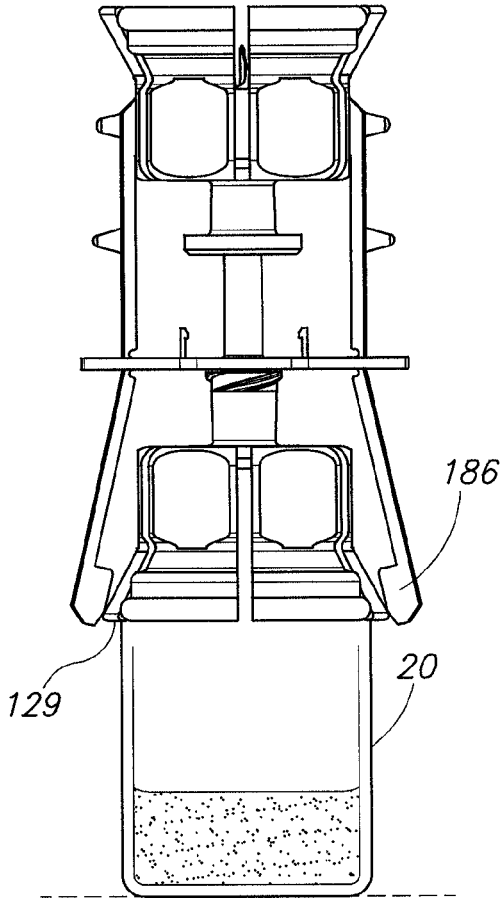
Figure 16C:
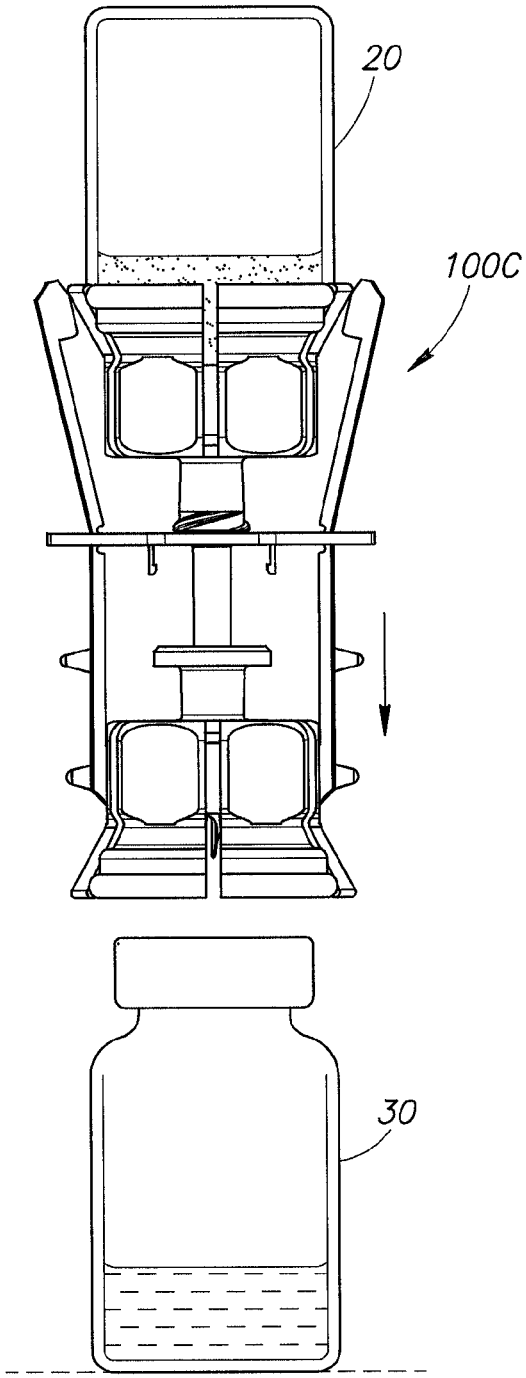
Figure 16D:
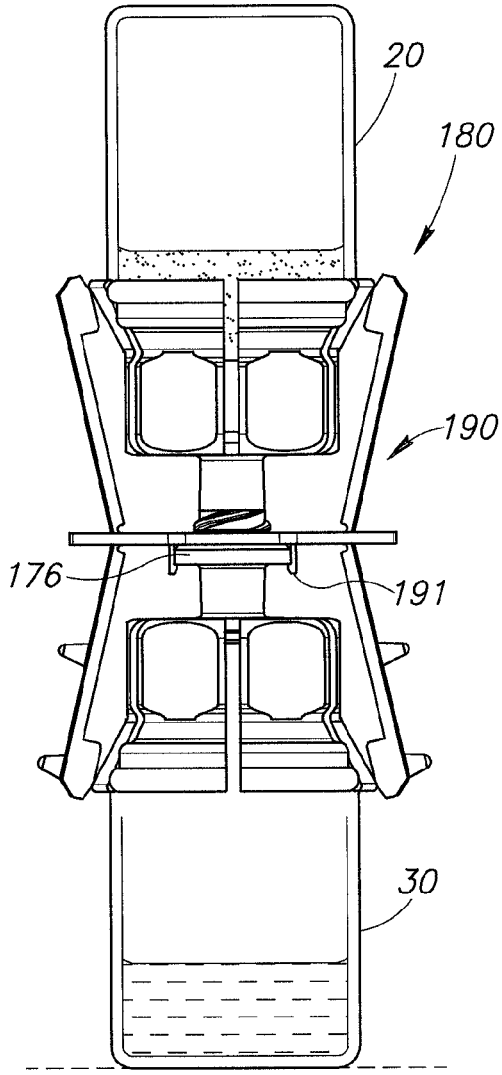
Figure 16G:
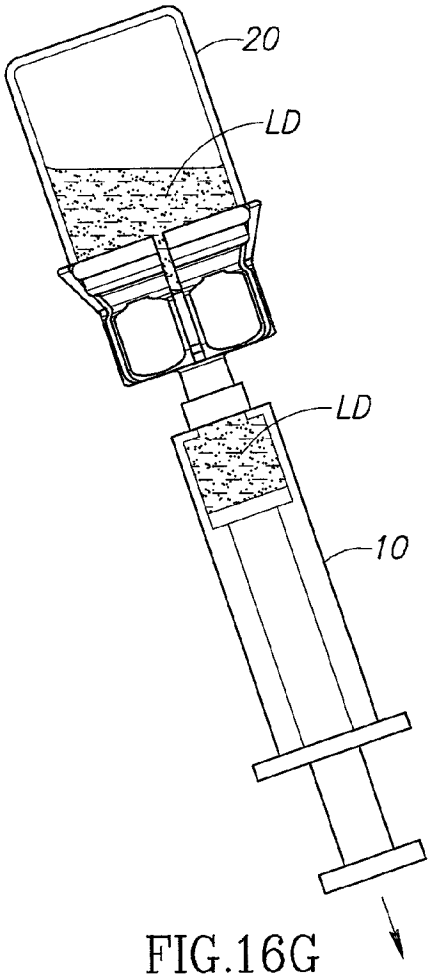
Figure 16F:
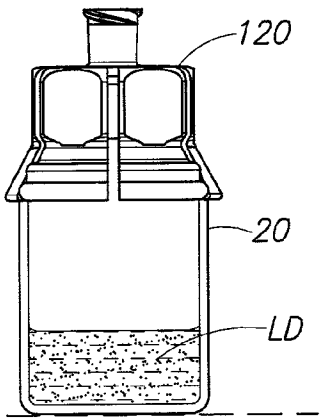
Figure 16E:
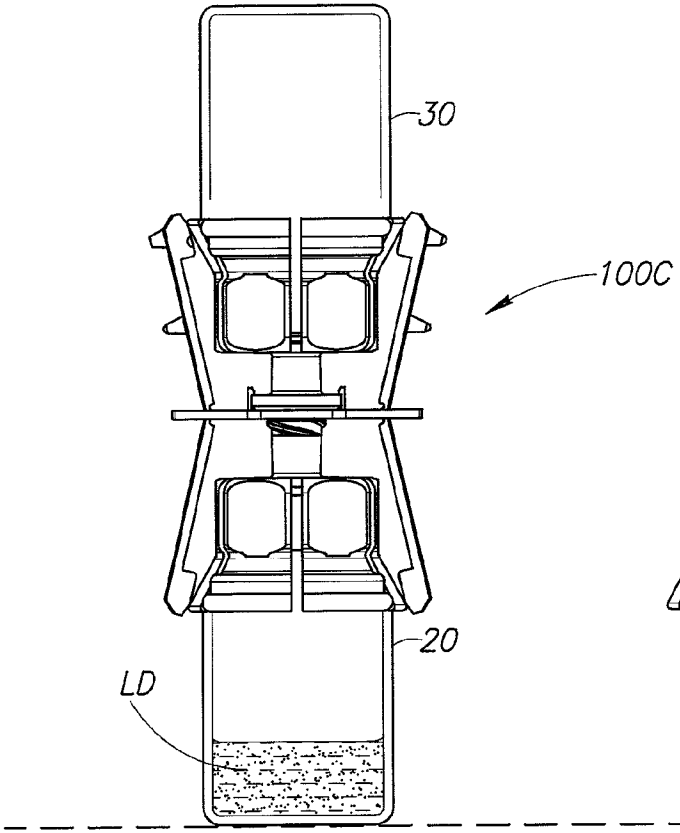

FIG. 9 is a longitudinal cross section of FIG. 7's liquid drug transfer assembly in its initial ready to use state along line B-B in FIG. 7;

FIG. 10A shows FIG. 7's liquid drug transfer assembly co-axial with a drug vial ready for snap fitting thereon;

FIG. 10B shows FIG. 7's liquid drug transfer assembly snap fitted on the drug vial;

FIG. 10C shows inversion of the FIG. 10B assemblage ready for snap fitting on the liquid vial;

FIG. 10D shows the FIG. 10B assemblage snap fitted on the liquid vial;

FIG. 10E shows the FIG. 10D assemblage in an inverted position for enabling gravitational liquid transfer from the liquid vial to the drug vial to form liquid drug contents in the drug vial and venting from the drug vial to the liquid vial;

FIG. 10F shows the drug vial adapter mounted on the drug vial containing liquid drug contents after removal of the liquid drug vial with its attached empty liquid vial;

FIG. 10G shows use of the needleless syringe for aspirating liquid drug contents from the drug vial for administration purposes;

FIG. 11 is a pictorial representation of a third preferred embodiment of a liquid drug transfer assembly including a liquid drug transfer device, a drug vial adapter, and a liquid vial adapter in its initial ready to use state, a blister pack for long term storage of same, a needleless syringe, a drug vial, and a liquid vial;

FIG. 12 is a perspective view of FIG. 11's liquid drug transfer assembly;

FIG. 13 is an exploded view of FIG. 11's liquid drug transfer assembly and an enlarged transverse cross section of the dual ended dual lumen linear transfer spike of the liquid drug transfer device;

FIG. 14 is a longitudinal cross section of FIG. 11's liquid drug transfer assembly in its initial ready to use state along line C-C in FIG. 11;

FIG. 15A is a longitudinal cross section of FIG. 11's liquid drug transfer assembly co-axial with the drug vial ready for snap fitting thereon;

FIG. 15B is a longitudinal cross section of FIG. 11's liquid drug transfer assembly pursuant to an initial downward depression of the liquid drug transfer assembly toward the drug vial;

FIG. 15C is a longitudinal cross section of FIG. 11's liquid drug transfer assembly pursuant to further downward depression of the liquid drug transfer assembly towards the drug vial;

FIG. 15D is a longitudinal cross section of FIG. 11's liquid drug transfer assembly pursuant to still further downward depression of the liquid drug transfer assembly towards the drug vial;

FIG. 15E is a longitudinal cross section of FIG. 11's liquid drug transfer assembly pursuant to complete snap fitting of the drug vial adapter on the drug vial;

FIG. 15F is a longitudinal cross section of FIG. 11's liquid drug transfer assembly showing complete snap fitting of both the drug vial and the liquid vial including snap fit engagement of the liquid drug transfer device and the liquid vial adapter;

FIG. 16A shows FIG. 11's liquid drug transfer assembly co-axial with a drug vial ready for snap fitting thereon;

FIG. 16B shows FIG. 11's liquid drug transfer assembly snap fitted on the drug vial;

FIG. 16C shows inversion of the FIG. 16B assemblage ready for snap fitting on the liquid vial;

FIG. 16D shows the FIG. 16B assemblage snap fitted on the liquid vial;

FIG. 16E shows the FIG. 16D assemblage in an inverted position for enabling gravitational liquid transfer from the liquid vial to the drug vial to form liquid drug contents in the drug vial and venting from the drug vial to the liquid vial;

FIG. 16F shows the drug vial adapter mounted on the drug vial containing liquid drug contents after removal of the liquid drug transfer device and the liquid drug adapter with its attached empty liquid vial; and FIG. 16G shows use of the needleless syringe for aspirating liquid drug contents from the drug vial for administration purposes.

DETAILED DESCRIPTION OF THE INVENTION

Figure 1:
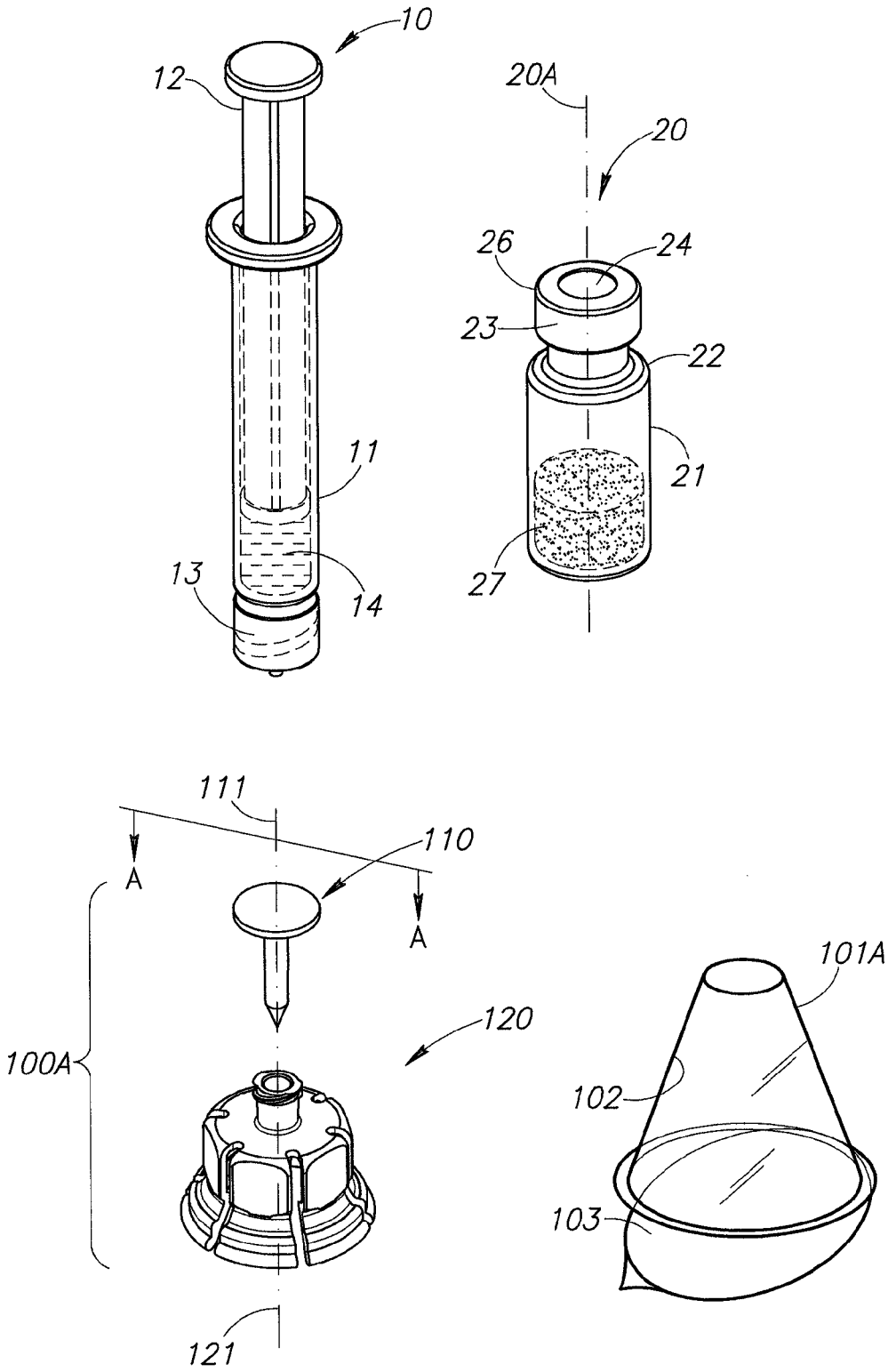

FIG. 1 shows a liquid drug transfer assembly 100A for use with a needleless syringe 10 and a drug vial 20. The syringe 10 includes a barrel 11 with a plunger 12 and a male Luer lock connector 13. The syringe 10 can be formed with other types of male connectors. The syringe 10 is filled with a liquid component 14. The liquid component 14 can be diluent only. Alternatively, the liquid component 14 can include an active component. The drug vial 20 has a longitudinal drug vial axis 20A and includes a drug vial bottle 21 having a drug vial shoulder 22 and a drug vial opening 23 sealed by a drug vial stopper 24. The drug vial opening 23 has an uppermost outermost drug vial rim 26. The drug vial 20 contains a drug component 27. The liquid drug transfer assembly 100A is preferably packaged in a blister pack 101A having an internal surface 102 and a protective seal 103.

Figure 2:
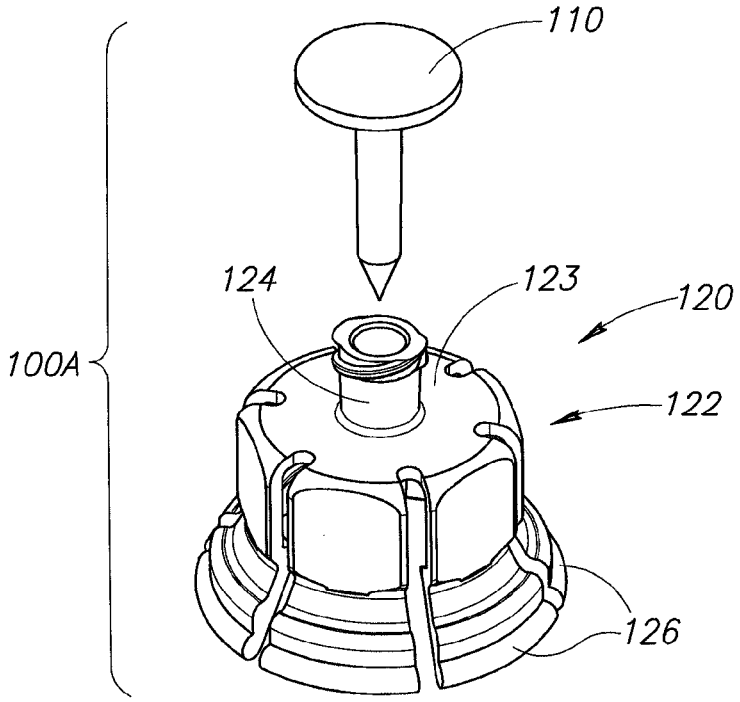
Figure 3:
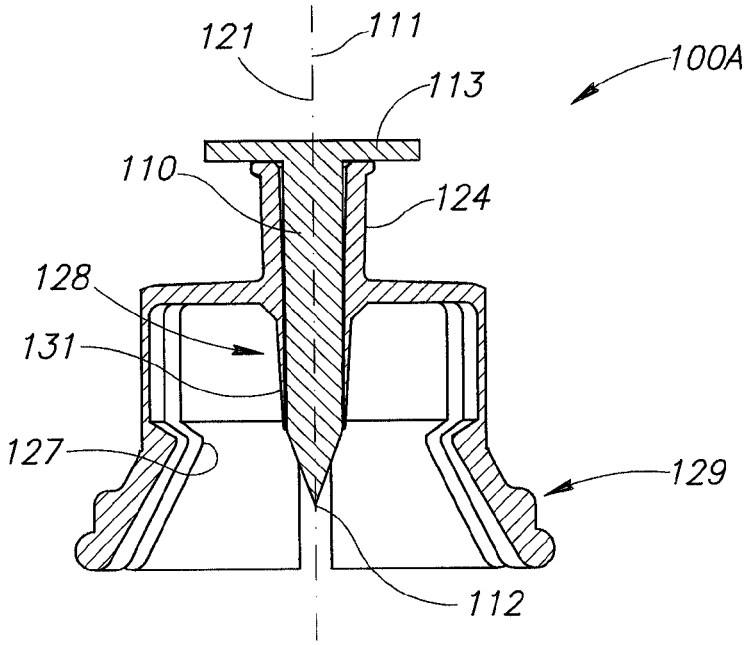

FIGS. 1 to 3 show the liquid drug transfer assembly 100A includes a drug vial stopper puncturing member 110 having a longitudinal drug vial stopper puncturing member axis 111 and a drug vial adapter 120. The blister pack 101A is shaped and dimensioned to snugly fit the liquid drug transfer assembly 100A inside and employed for mounting same on the drug vial 20. The drug vial stopper puncturing member 110 has a drug vial stopper puncturing tip 112 for puncturing the drug vial stopper 24 and a transverse directed head 113.

The drug vial adapter 120 has a longitudinal drug vial adapter axis 121 and includes a drug vial adapter skirt 122 having a transversely directed drug vial adapter top surface 123 formed with an upright drug vial adapter port 124 and a multitude of six downward depending drug vial adapter flex members 126. The drug vial adapter flex members 126 are provided with internal directed protrusions 127 for snap fitting under the drug vial opening 23 and define a drug vial adapter body portion 128 for snugly receiving the drug vial opening 23. The drug vial adapter flex members 126 define a drug vial adapter skirt margin 129 outwardly flared with respect to the drug vial adapter body portion 128 for assisting in guidance of the drug vial adapter 120 on the drug vial 20. The drug vial adapter port 124 is preferably implemented as a female Luer connector for screw thread engagement of the needleless syringe 10 thereon. Alternatively, the drug vial adapter port 124 can be formed with a wide diameter, for example, for enabling gravitational flow of viscous liquid drug contents from a drug vial 20.

The drug vial adapter 120 also includes a downward depending drug vial adapter sleeve 131 opposite the drug vial adapter port 124 and in flow communication therewith. The drug vial adapter 120 including the drug vial adapter port 124 and the drug vial adapter sleeve 131 can be formed as a single injection plastic molded unit from the same suitable plastic material, for example, polycarbonate, and the like. The drug vial adapter sleeve 131 stops short of the drug vial stopper puncturing tip 112 in an initial set-up position of the liquid drug transfer assembly 100A such that the drug vial stopper puncturing tip 112 protrudes therebeyond. Thus, the drug vial stopper puncturing tip 112 contacts a drug vial stopper 24 before the drug vial adapter sleeve 131 on mounting the liquid drug transfer assembly 100A on the drug vial 20.

Figure 4A:
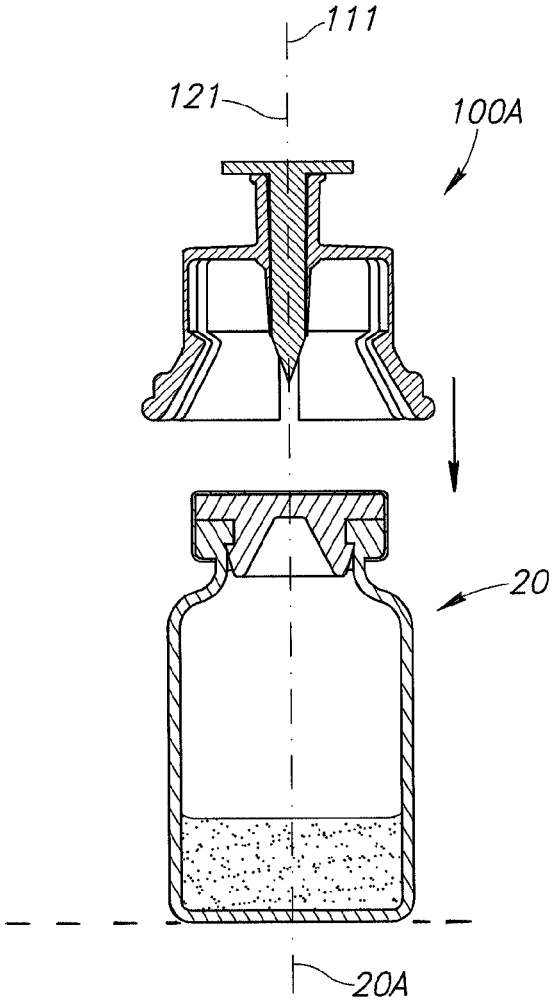

FIGS. 4A to 4D show the use of the liquid drug transfer assembly 100A for liquid drug reconstitution and administration as follows:

FIG. 4A shows the liquid drug transfer assembly 100A in its initial ready to use state for snap fitting on the drug vial 20 by downward depression of the former 100A towards the latter 20.

Figure 4B:
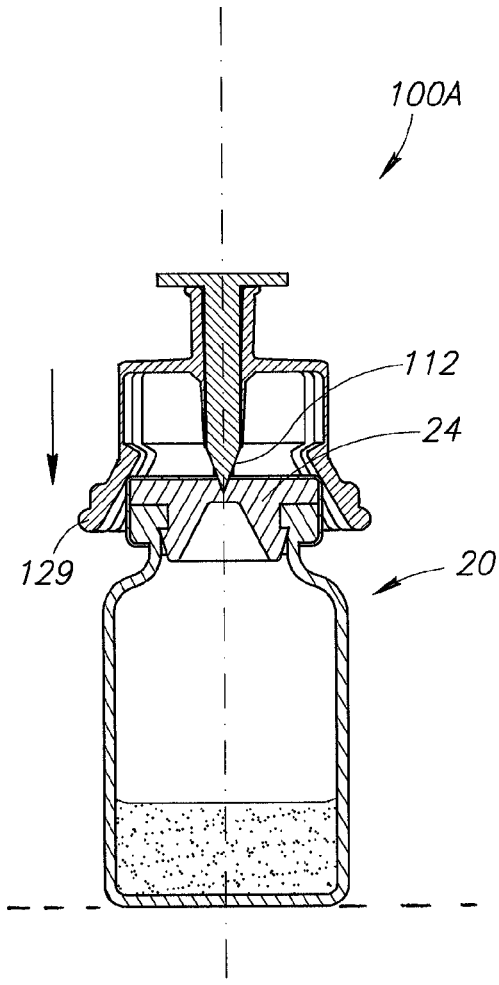

FIG. 4B shows initial downward depression of the liquid drug transfer assembly 100A towards the drug vial 20 simultaneously causing the drug vial adapter skirt margin 129 to co-axially align the drug vial adapter 120 with the drug vial 20 and the drug vial stopper puncturing tip 112 to begin to puncture the drug vial stopper 24.

Figure 4C:
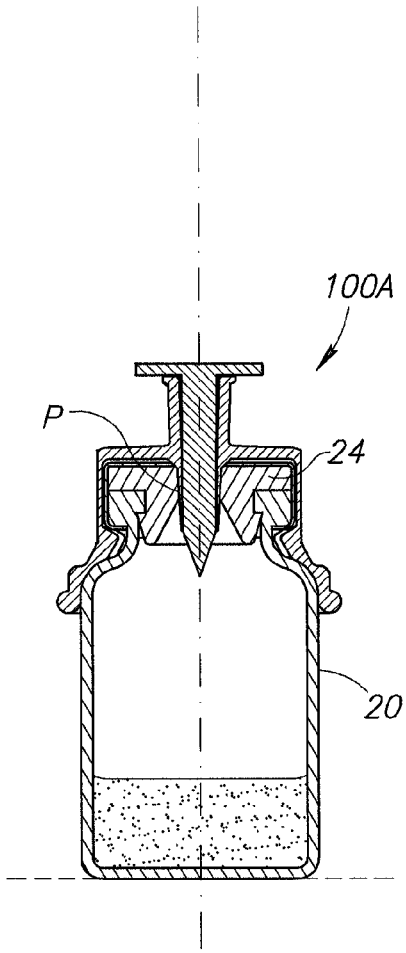

FIG. 4C shows complete snap fitting of the liquid drug transfer assembly 100A on the drug vial 20 including the complete penetration of the drug vial stopper penetrating member 110 through the drug vial stopper 24 to form a throughgoing puncture bore P.

Figure 4D:
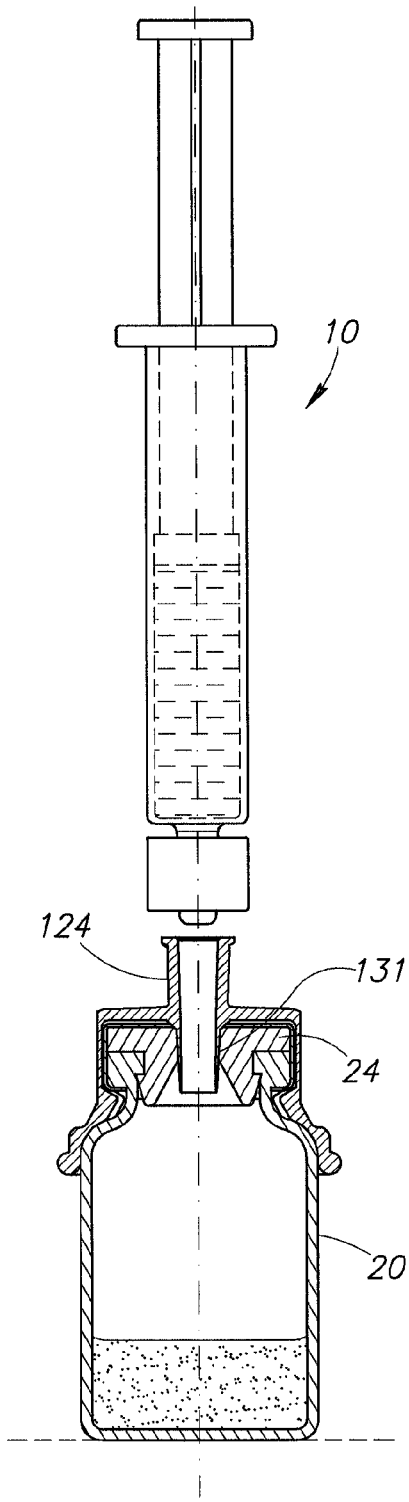

FIG. 4D shows removal of the drug vial stopper penetrating member 110 from the drug vial 20 leaving the drug vial adapter 120 in place. The drug vial adapter sleeve 131 lines the puncture bore P to prevent the drug vial stopper 24 sealing itself. The drug vial adapter sleeve 131 also prevents any drug vial stopper remnants falling into the drug vial bottle to contaminate the vial contents. The needleless syringe 10 can be readily mounted on the female Luer connector 124 for injecting its contents into the drug vial bottle 21 for reconstitution or dilution purposes.

Figure 5:
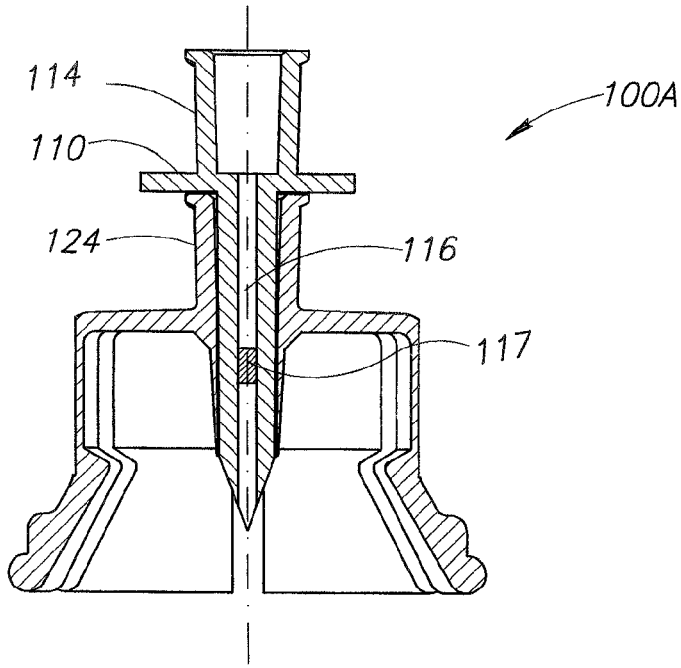

FIG. 5 shows the liquid drug transfer assembly 100A including a drug vial stopper puncturing member 110 having a liquid drug access port 114 with a longitudinal lumen 116 for enabling flow communication access to the drug vial bottle 21 on puncturing of the drug vial stopper 24. The liquid drug access port 114 can be optionally formed as a female Luer connector. The liquid drug access port 114 and/or longitudinal lumen 116 can be optionally formed with an in-line filter 117.

Figure 6:
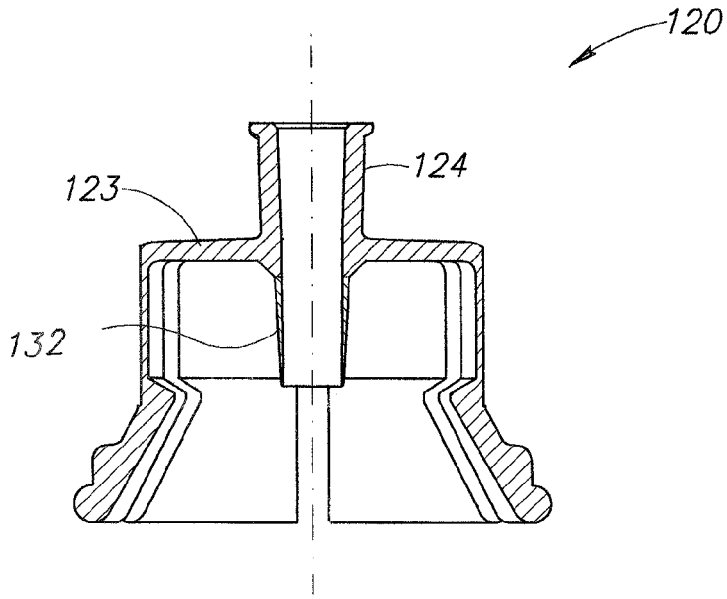

FIG. 6 shows an alternative embodiment of the drug vial adapter 120 including a drug vial adapter sleeve component 133 mounted on its drug vial adapter top surface 123. The drug vial adapter sleeve component 133 can be formed from a material different from the rest of the drug vial adapter 120. Suitable materials include inter alia elastomer materials, metal, neoprene fabrics, rubber, silicone, glass, and the like.

FIG. 7 shows a liquid drug transfer assembly 100B for use with an empty syringe 10, a drug vial 20 and a liquid vial 30. The liquid vial 30 has a longitudinal axis 30A and includes a liquid vial bottle 31 having a liquid vial shoulder 32 and a liquid drug vial opening 33 stopped by a liquid vial stopper 34. The liquid vial opening 33 has an uppermost outermost liquid vial rim 36. The liquid vial 30 contains a liquid component 37 for adding to the drug component 27. The liquid drug transfer assembly 100B is preferably packaged in a blister pack 101B shaped and dimensioned to snugly fit the liquid drug transfer assembly 100B inside and employed for operation of same.

Figure 8:
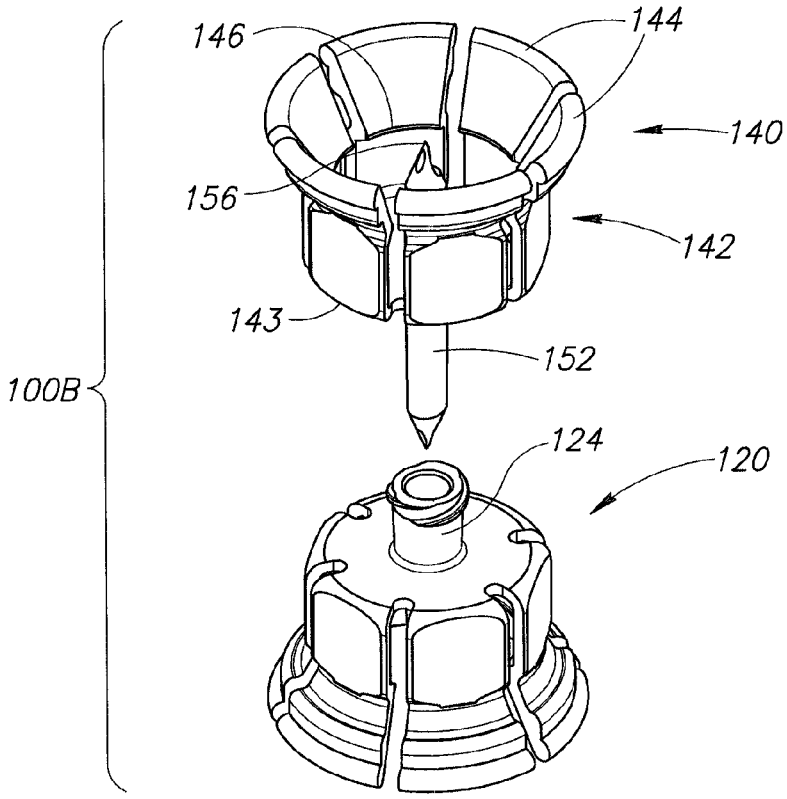

FIGS. 7 to 9 show the liquid drug transfer assembly 100B includes a drug vial adapter 120 and a liquid vial adapter 140. The liquid vial adapter 140 has a longitudinal liquid vial adapter axis 141 and includes a liquid vial adapter skirt 142 having a transversely directed liquid vial adapter top surface 143 formed with a multitude of six downward depending liquid vial adapter flex members 144. The liquid vial adapter flex members 144 are provided with internal directed protrusions 146 for snap fitting under the liquid vial opening 33 and define a liquid vial adapter body portion 147 for snugly receiving the liquid vial opening 33. The liquid vial adapter flex members 144 define a liquid vial adapter skirt margin 148 outwardly flared with respect to the liquid vial adapter body portion 147 for assisting in guidance of the liquid vial adapter 140 on the liquid vial 30.

The liquid vial adapter 140 also includes a dual ended dual lumen linear transfer spike 151 having a drug vial stopper puncturing member 152 for puncturing the drug vial stopper 24 and an opposite liquid vial stopper puncturing member 153 for puncturing the liquid vial stopper 34. The drug vial stopper puncturing member 152 extends from the liquid vial adapter top surface 143 away from the liquid vial adapter skirt 142. The drug vial stopper puncturing member 152 terminates at a drug vial stopper puncturing tip 154 which extends beyond the drug vial adapter sleeve 131 on mounting the liquid drug vial adapter 140 on the drug vial adapter 120. The liquid vial stopper puncturing member 153 extends from the liquid vial adapter top surface 143 into the liquid vial adapter skirt 142. The liquid vial stopper puncturing member 153 terminates at a liquid vial stopper puncturing tip 156. The dual ended dual lumen linear transfer spike 151 includes a liquid transfer lumen 157 for liquid transfer from the liquid vial 30 to the drug vial 20 and an air transfer lumen 158 for air transfer from the drug vial 20 to the liquid vial 30 for pressure equalization purposes.

FIGS. 10A to 10G show the use of the liquid drug transfer assembly 100B for liquid drug reconstitution and administration as follows:

FIG. 10A shows the liquid drug transfer assembly 100B in its initial ready to use state for snap fitting on the drug vial 20 by downward depression of the former 100 towards the latter 20.

FIG. 10B shows complete snap fitting of the liquid drug transfer assembly 100B including the complete penetration of the drug vial stopper penetrating member 152 through the drug vial stopper 24 to form a throughgoing puncture bore P.

FIG. 10C shows inversion of the FIG. 10B assemblage ready for snap fitting the liquid vial adapter 140 on the liquid vial 30.

FIG. 4D shows complete snap fitting of the liquid drug transfer assembly 100B including the drug vial 20 on the liquid vial 30.

FIG. 10E shows inversion of the FIG. 10D assemblage for enabling gravitational liquid transfer from the liquid vial 30 to the drug vial 20 to form liquid drug contents LD in the drug vial 20 and venting from the drug vial 20 to the liquid vial 30. A user may gently agitate the inverted FIG. 10D assemblage to facilitate reconstitution or dilution depending on the drug component and the liquid component.

FIG. 10F shows removal of the liquid vial adapter 140 together with its attached empty liquid vial 30 to leave the drug vial 20 with the liquid drug contents LD. The drug vial adapter sleeve 131 lines the puncture bore P to prevent the drug vial stopper sealing itself. The drug vial adapter sleeve 131 also prevents any drug vial stopper remnants falling into the drug vial bottle to contaminate the contents.

FIG. 10G shows use of the needleless syringe 10 for aspirating liquid drug contents LD from the drug vial 20 for administration purposes.

FIGS. 11 to 14 show a liquid drug transfer assembly 100C for use with an empty syringe 10, a drug vial 20 and a liquid vial 30. The liquid drug transfer assembly 100C has a triple component construction including a drug vial adapter 160, a liquid vial adapter 170 and a liquid drug transfer device 180 having a longitudinal liquid drug transfer device axis 181. The liquid drug transfer assembly 100C is preferably packaged in a blister pack 101C shaped and dimensioned to snugly fit the liquid drug transfer assembly 100C inside and employed for operation of same.

The drug vial adapter 160 has the same construction as the drug vial adapter 120 and therefore similar parts are likewise numbered. The drug vial adapter 160 differs from the drug vial adapter 120 insofar as the former 160 includes an opposite pair of drug vial adapter flex members 161 formed with throughgoing drug vial leg tip apertures 162 in the region of the drug vial adapter body portion 128. Also, the drug vial adapter flex members 161 have smooth external surfaces 163 in the region of the drug vial adapter skirt margin 129 as opposed to the ridged surfaces of the drug vial adapter flex members 126.

The liquid vial adapter 170 has the same construction as the liquid vial adapter 140 and therefore similar parts are likewise numbered. The liquid vial adapter 170 differs from the liquid vial adapter 140 insofar as the former 170 includes an opposite pair of liquid vial adapter flex members 171 formed with throughgoing liquid vial leg tip apertures 172 in the region of the liquid vial adapter body portion 147. Also, the liquid vial adapter flex members 171 have smooth external surfaces 173 in the region of the liquid vial adapter skirt margin 148 as opposed to the ridged surfaces of the liquid drug vial adapter flex members 144.

And additionally, the liquid vial adapter 170 is formed without the dual ended dual lumen linear transfer spike 151 and instead has an upright tubular member 174 extending from the liquid vial adapter top surface 143 away from the liquid vial adapter skirt 142. The tubular member 174 includes a transversely directed flange 176.

The liquid drug transfer device 180 has a similar construction to the dual ended dual lumen linear transfer spike 151 and therefore similar parts are likewise numbered. The liquid drug transfer device 180 includes a drug vial stopper puncturing member 152 terminating at a drug vial stopper puncturing tip 154 and an opposite liquid vial stopper puncturing member 153 terminating at a liquid vial stopper puncturing tip 156. The liquid drug transfer device 180 includes a liquid transfer lumen 157 and an air transfer lumen 158. The liquid transfer lumen 157 has a larger lumen cross section area than the air transfer lumen 158. The liquid transfer lumen 157 has a generally crescent transverse cross section which partially wraps around the air transfer lumen 158 thereby reducing the overall transfer spike cross sectional area for facilitating puncturing of the drug and liquid vial stoppers 24 and 34.

The liquid drug transfer device 180 is additionally formed with a transverse directed spacing collar 182 rigidly mounted midway therealong, a pair of longitudinal directed drug vial legs 183 hinged on the spacing collar 182 and extending co-directional with and spaced apart from the drug vial stopper puncturing member 152 and a pair of longitudinal directed liquid vial legs 184 hinged on the spacing collar 182 and extending co-directional with and spaced apart from the liquid vial stopper puncturing member 153. The drug vial legs 183 terminate at drug vial leg tips 186 co-extensive with and inwardly protruding toward the drug vial stopper puncturing tip 154. The drug vial leg tips 186 are intended to be initially inserted into the throughgoing apertures 162. The liquid vial legs 184 terminate at liquid vial leg tips 187 co-extensive with and inwardly protruding toward the liquid vial stopper puncturing tip 156. The liquid vial leg tips 187 are intended to be initially inserted into the throughgoing apertures 172.

The liquid vial legs 184 are preferably each formed with a pair of outwardly directed liquid vial leg protrusions 188 for bearing against the blister pack 101C's internal surface 102 for assisting in the snap fitting of the liquid drug transfer assembly 100C on the drug vial 20.

The liquid drug transfer assembly 100C includes a snap fit arrangement 190 for mechanically attaching the liquid vial adapter 140 to the spacing collar 182 on snap fitting the liquid vial adapter 140 on the liquid vial 30. The snap fit arrangement 190 is constituted by the tubular member 174 and the spacing collar 182 having a pair of snap members 191 for snap fitting on the transversely directed flange 176.

FIGS. 15A to 15E show the operation of the liquid drug transfer assembly 100C for snap fitting on the drug vial 20.

FIG. 15A shows the liquid drug transfer assembly 100C co-axial with the drug vial 20 ready for snap fitting thereon.

FIG. 15B shows an initial downward depression of the liquid drug transfer assembly 100C toward the drug vial 20. The drug vial leg tips 186 urge the drug vial adapter skirt margin 129 to co-axially align the drug vial adapter 120 with the drug vial 20 and the drug vial stopper puncturing tip 156 to begin to puncture the drug vial stopper 24.

FIG. 15C shows further downward depression of the liquid drug transfer assembly 100C towards the drug vial 20 leading to complete snap fitting of the drug vial adapter 120 on the drug vial 20 and complete puncturing of the drug vial stopper 24 to form a throughgoing puncture bore P. The drug vial adapter sleeve 131 lines the follows the puncture bore P. The drug vial rim 26 begins to urge the drug vial leg tips 186 outwardly from their respective drug vial leg tip apertures 162.

FIG. 15D shows still further downward depression of the liquid drug transfer assembly 100C towards the drug vial 20 to cause the drug vial leg tips 186 to leave their respective drug vial leg tip apertures 162 such that the liquid drug transfer device 180 is free to effect a sliding downward movement relative to the drug vial adapter 120. The drug vial leg tips 186 begin to slide down the smooth external surfaces 163 of their respective drug flex members 161.

FIG. 15E shows yet still further downward depression of the liquid drug transfer assembly 100C towards the drug vial 20 leading to the drug vial leg tips 186 resting on the drug vial adapter skirt margin 129.

The liquid drug transfer assembly 100C snap fits onto the liquid vial 30 in a similar manner as it snap fits onto the drug vial 20. The liquid drug transfer device 180 additionally snap fits on the liquid vial adapter 140 for enabling convenient removal of the two components and the empty liquid vial 30 after forming the liquid drug contents in the drug vial 20.

FIG. 15F shows the operation of the snap fit arrangement 190, namely, the snap fit members 191 snapping onto the tubular member 174's flange 176.

FIGS. 16A to 16G show the use of the liquid drug transfer assembly 100C for liquid drug reconstitution and administration as follows:

FIG. 16A shows the liquid drug transfer assembly 100C in its initial ready to use state for snap fitting on the drug vial 20 by downward depression of the former 100 towards the latter 20.

FIG. 16B shows the downward depression of the liquid drug transfer assembly 100C towards the drug vial 20 causes the liquid drug transfer device 180 to urge the drug vial adapter 120 downwards to snap fit on the drug vial 20 and the drug vial puncturing member 152 to puncture the drug vial stopper 24 and the drug vial adapter sleeve 131 to line the puncture bore P. Also, the downward movement of the liquid drug transfer device 180 causes the drug vial leg tips 186 to be urged outward from the drug vial adapter 120 and rest on the drug vial adapter skirt margin 129.

FIG. 16C shows inversion of the FIG. 6B assemblage for snap fitting on the liquid vial 30.

FIG. 16D shows the downward depression of the liquid drug transfer assembly 100C towards the drug vial 30 causes the liquid drug transfer device 180 to urge the liquid vial adapter 140 downwards to snap fit on the liquid vial 30 and the liquid vial puncturing member 153 to puncture the liquid vial stopper 24. Also, the downward movement of the liquid drug transfer device 180 causes the liquid vial leg tips 187 to be urged outward from the liquid vial adapter 140 and rest on the liquid vial adapter skirt margin 148. The downward movement also causes the actuation of the snap fit arrangement 190 between the liquid drug transfer device 180 and the liquid drug adapter 140.

FIG. 16E shows inversion of the FIG. 16D assemblage for enabling gravitational liquid transfer from the liquid vial 30 to the drug vial 20 to form liquid drug contents LD in the drug vial 20 and venting from the drug vial 20 to the liquid vial 30. A user may gently agitate the inverted FIG. 16D assemblage to facilitate reconstitution or dilution of the liquid drug contents LD.

FIG. 16F shows the drug vial adapter 120 mounted on the drug vial 20 containing liquid drug contents LD after removal of the liquid drug transfer device 180 together with the liquid drug adapter 140 and its attached empty liquid vial 30.

FIG. 16G shows use of the needleless syringe 10 for aspirating liquid drug contents LD from the drug vial 20 for administration purposes.

While the invention has been described with respect to a limited number of embodiments, it will be appreciated that many variations, modifications, and other applications of the invention can be made within the scope of the appended claims.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A liquid drug transfer assembly for use with a drug vial including a drug vial bottle containing a drug component and having a drug vial opening stopped by a drug vial stopper, the liquid drug transfer assembly comprising:

(a) a drug vial stopper puncturing member with a drug vial stopper puncturing tip for puncturing the drug vial stopper; and (b) a drug vial adapter having a longitudinal drug vial adapter axis and including a drug vial adapter skirt having a transversely directed drug vial adapter top surface formed with an upright drug vial adapter port, a drug vial adapter body portion for snugly receiving the drug vial opening and a drug vial adapter skirt margin remote from said drug vial adapter top surface, and a drug vial adapter sleeve downward depending from said drug vial adapter top surface opposite said upright drug vial adapter port and in flow communication therewith, said drug vial adapter being slidingly disposed on said drug vial stopper puncturing member such that said drug vial stopper puncturing tip protrudes beyond said drug vial adapter sleeve, the arrangement being such that on mounting the liquid drug transfer assembly on the drug vial, said drug vial stopper puncturing member punctures the drug vial stopper to form a throughgoing puncture bore and said drug vial adapter sleeve lines said puncture bore whereby, on withdrawal of said drug vial stopper puncturing member from said puncture bore, said drug vial adapter sleeve prevents the drug vial stopper from sealing itself thereby enabling flow communication between said drug vial adapter port and the drug vial bottle.

2. The assembly according to claim 1, wherein said drug vial adapter skirt, said drug vial adapter port and said drug vial adapter sleeve are formed as a single injection plastic molded unit from the same plastic material.

3. The assembly according to claim 1, wherein said drug vial adapter sleeve is mounted on said drug vial adapter skirt and is formed from a different material therefrom.

4. The assembly according to claim 1, wherein said drug vial stopper puncturing member includes a liquid drug access port and a longitudinal lumen for enabling flow communication access to the drug vial bottle on said puncturing of the drug vial stopper.

5. The assembly according to claim 4, wherein drug vial stopper puncturing member includes an in-line filter.

6. The assembly according to claim 1, for additional use with a liquid vial including a liquid vial bottle containing a liquid component and having a liquid vial opening stopped by a liquid vial stopper, the liquid component intended for adding to the drug component to form liquid drug contents, wherein said drug vial stopper puncturing member is formed as a dual ended dual lumen linear transfer spike integrally formed with a liquid vial adapter including a liquid vial adapter skirt having a transversely directed liquid vial adapter top surface and a liquid vial adapter body portion for snugly receiving the liquid vial opening therein, said dual ended dual lumen linear transfer spike including a liquid vial stopper puncturing member opposite said drug vial stopper puncturing member, said liquid vial stopper puncturing member having a liquid vial stopper puncturing tip for puncturing the liquid vial stopper on mounting the liquid vial adapter on the liquid vial thereby enabling simultaneous gravitational flow of liquid component from the liquid vial to the drug vial and air flow from the drug vial to the liquid vial on forming an upright assemblage of an uppermost liquid vial and a lowermost drug vial for forming liquid drug contents in the drug vial for administration purposes on removal of the liquid vial adapter from the drug vial adapter.

7. The assembly according to claim 1, for additional use with a liquid vial including a liquid vial bottle containing a liquid component and having a liquid vial opening stopped by a liquid vial stopper, the liquid component intended for adding to the drug component to form liquid drug contents, said wherein said drug vial stopper puncturing member is formed as one end of a dual ended dual lumen linear transfer spike having a longitudinal axis and including i) an opposite directed liquid vial stopper puncturing member with a liquid vial stopper puncturing tip for puncturing the liquid vial stopper, ii) a transverse directed spacing collar rigidly mounted on said linear transfer spike, iii) at least two longitudinal directed drug vial legs mounted on said spacing collar and extending co-directional with and spaced apart from said drug vial stopper puncturing member, said at least two drug vial legs terminating at drug vial leg tips co-extensive with and inwardly protruding toward said drug vial stopper puncturing tip, iv) at least two longitudinal directed liquid vial legs mounted on said spacing collar and extending co-directional with and spaced apart from said liquid vial stopper puncturing member, said at least two liquid vial legs terminating at liquid vial leg tips co-extensive with and inwardly protruding toward said liquid vial stopper puncturing tip, said drug vial adapter being slidingly mounted on said drug vial stopper puncturing member with said drug vial adapter top surface towards said spacing collar and said drug vial adapter skirt margin remote therefrom, said drug vial adapter skirt having drug vial leg tip apertures for initially receiving said drug vial leg tips for initially spacing said drug vial adapter from said spacing collar such that said drug vial adapter skirt margin is further from said spacing collar than said drug vial puncturing tip whereby, on sliding said drug vial adapter towards said spacing collar, said drug vial adapter skirt mounts on the drug vial opening for enclosing the drug vial opening in said drug vial adapter body portion, said drug vial stopper puncturing member punctures the drug vial stopper for flow communication with the drug vial bottle and said drug vial leg tips slide along said drug vial adapter skirt towards said drug vial adapter skirt margin; and (c) a liquid vial adapter including a liquid vial skirt adapter having a transversely directed liquid vial adapter top surface formed with a liquid vial adapter body portion for snugly receiving the liquid vial opening and a liquid vial adapter skirt margin, said liquid vial adapter being slidingly disposed on said liquid vial stopper puncturing member with said liquid vial adapter top surface towards said spacing collar and said liquid vial adapter skirt margin remote therefrom, said liquid vial adapter skirt having liquid vial leg tip apertures for initially receiving said liquid vial leg tips for initially spacing said liquid vial adapter from said spacing collar such that said liquid vial adapter skirt margin is further from said spacing collar than said liquid vial stopper puncturing tip whereby, on sliding said liquid vial adapter towards said spacing collar, said liquid vial adapter skirt mounts on the liquid vial opening for enclosing the liquid vial opening in said liquid vial adapter body portion, said liquid vial stopper puncturing member punctures the liquid vial stopper for flow communication with the liquid vial bottle and said liquid vial leg tips slide along said liquid vial adapter skirt towards said liquid vial adapter skirt margin.

8. The assembly according to claim 7, wherein said liquid drug transfer device and said liquid vial adapter have a snap fit arrangement for mechanically attaching said liquid drug transfer device to said liquid vial adapter on mounting said liquid vial adapter on the liquid vial.

9. The assembly according to claim 8, wherein said snap fit arrangement is constituted by said liquid vial adapter port having a longitudinal directed tubular member directed towards said spacing collar and said spacing collar having at least one snap member for snap fitting on said tubular member.

10. The assembly according to claim 7, wherein said drug vial adapter skirt margin is outwardly flared with respect to said drug vial adapter body portion and includes smooth external surfaces for facilitating said sliding of said drug vial leg tips towards said drug vial adapter skirt margin.

11. The assembly according to claim 7, wherein said liquid vial adapter skirt margin is outwardly flared with respect to said liquid vial adapter body portion and includes smooth external surfaces for facilitating said sliding of said liquid vial leg tips towards said liquid vial adapter skirt margin.

12. The assembly according to claim 7, wherein the liquid drug transfer assembly is packaged in a blister pack and each liquid vial leg has at least one outwardly directed liquid leg vial protrusion for bearing against an internal surface of said blister pack.

* * * * *